US009235179B2

(12) United States Patent
Watanabe

(10) Patent No.: US 9,235,179 B2
(45) Date of Patent: Jan. 12, 2016

(54) IMAGE FORMING APPARATUS FOR FORMING, DETECTING, AND CORRECTING SANDWICHED TONER PATTERN

(71) Applicant: CANON KABUSHIKI KAISHA, Tokyo (JP)

(72) Inventor: Shinri Watanabe, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/910,469

(22) Filed: Jun. 5, 2013

(65) Prior Publication Data

US 2013/0330108 A1 Dec. 12, 2013

(30) Foreign Application Priority Data

Jun. 8, 2012 (JP) ..... 2012-131297

(51) Int. Cl.
*G03G 15/00* (2006.01)
*G03G 15/01* (2006.01)

(52) U.S. Cl.
CPC ..... *G03G 15/5041* (2013.01); *G03G 15/5058* (2013.01); *G03G 15/0189* (2013.01); *G03G 2215/0129* (2013.01); *G03G 2215/0161* (2013.01)

(58) Field of Classification Search
CPC ..... G03G 2215/0161; G03G 15/5041; G03G 15/5058; G03G 15/0189
USPC ..... 399/301, 49
See application file for complete search history.

(56) References Cited

U.S. PATENT DOCUMENTS

| | | | | |
|---|---|---|---|---|
| 5,729,353 | A * | 3/1998 | Sawayama et al. | 358/300 |
| 6,408,156 | B1 * | 6/2002 | Miyazaki et al. | 399/301 |
| 6,714,748 | B1 * | 3/2004 | Nakayasu et al. | 399/72 |
| 7,027,748 | B2 * | 4/2006 | Funatani | 399/49 |
| 8,036,552 | B2 * | 10/2011 | Hashimoto | 399/49 |
| 2011/0280599 | A1 * | 11/2011 | Ino | G03G 15/0189 399/44 |
| 2011/0280633 | A1 | 11/2011 | Ino | |

FOREIGN PATENT DOCUMENTS

| | | | |
|---|---|---|---|
| EP | 2388652 | A2 | 11/2011 |
| JP | 9-267512 | A | 10/1997 |
| JP | 2005-031227 | A | 2/2005 |
| JP | 2007-272111 | A | 10/2007 |
| JP | 2009-093155 | A | 4/2009 |
| JP | 2009-244505 | A | 10/2009 |
| JP | 2012-003234 | A | 1/2012 |
| JP | 2012-108382 | A | 6/2012 |
| KR | 1020090031301 | A | 3/2009 |

OTHER PUBLICATIONS

English Translation of Ono, Hiroshi, Image Forming Apparatus. Oct. 14, 1997. Japanese Patent Office. JPH09-267512.*

* cited by examiner

*Primary Examiner* — Clayton E Laballe
*Assistant Examiner* — Trevor J Bervik
(74) *Attorney, Agent, or Firm* — Canon U.S.A., Inc. IP Division

(57) ABSTRACT

In an image forming apparatus, a control unit causes an image forming unit to form a positional deviation correction pattern, to sandwich a black developer image between two color developer images of a same color, and to superpose the black developer image on one of the two color developer images of the same color in a state where color deviation occurs between developer images of a plurality of different colors.

25 Claims, 18 Drawing Sheets

TOP VIEW OF POSITIONAL DEVIATION CORRECTION PATTERN

SECTIONAL VIEW OF POSITIONAL DEVIATION CORRECTION PATTERN

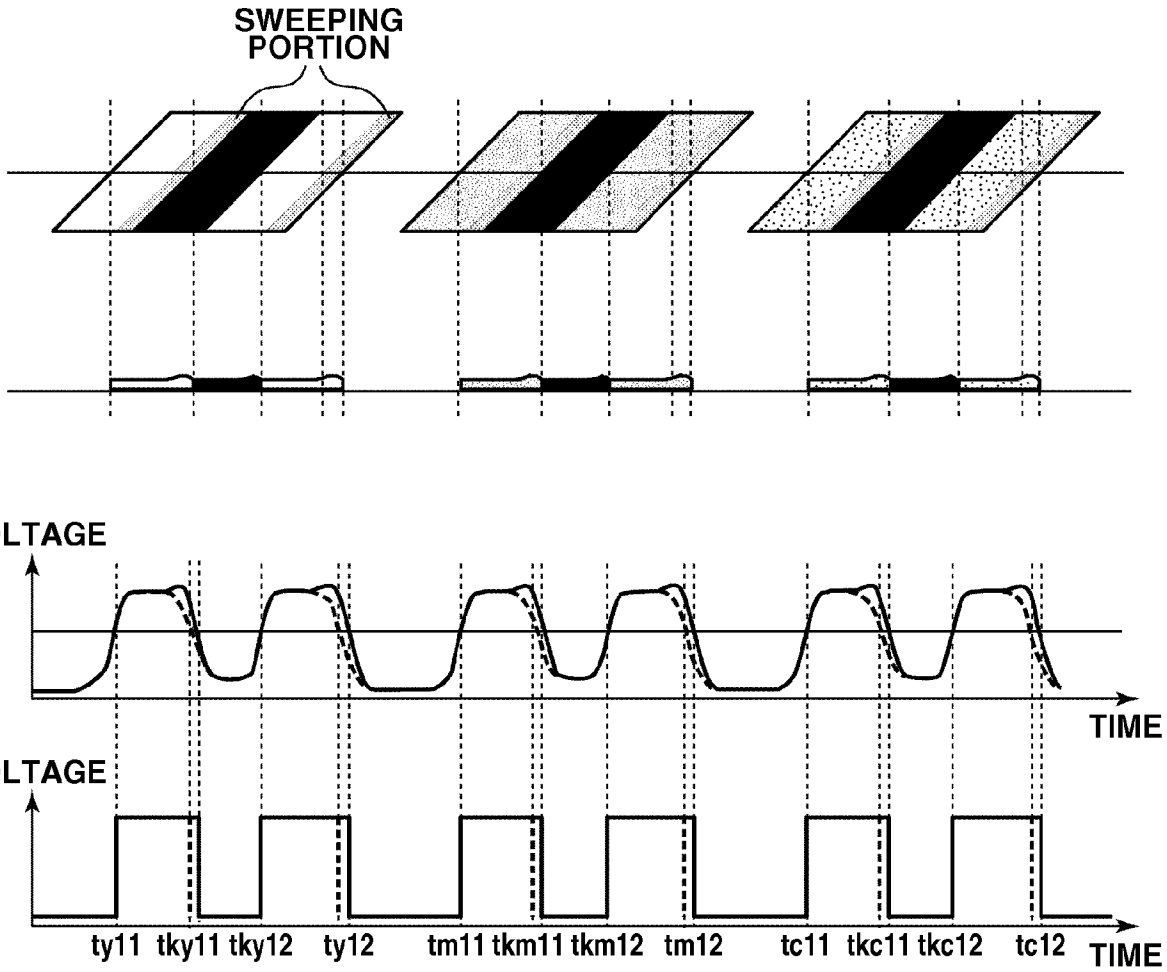
FIG.6A TOP VIEW OF POSITIONAL DEVIATION CORRECTION PATTERN
FIG.6B SECTIONAL VIEW OF POSITIONAL DEVIATION CORRECTION PATTERN
FIG.6C ANALOG OUTPUT SIGNAL
FIG.6D DIGITAL OUTPUT SIGNAL

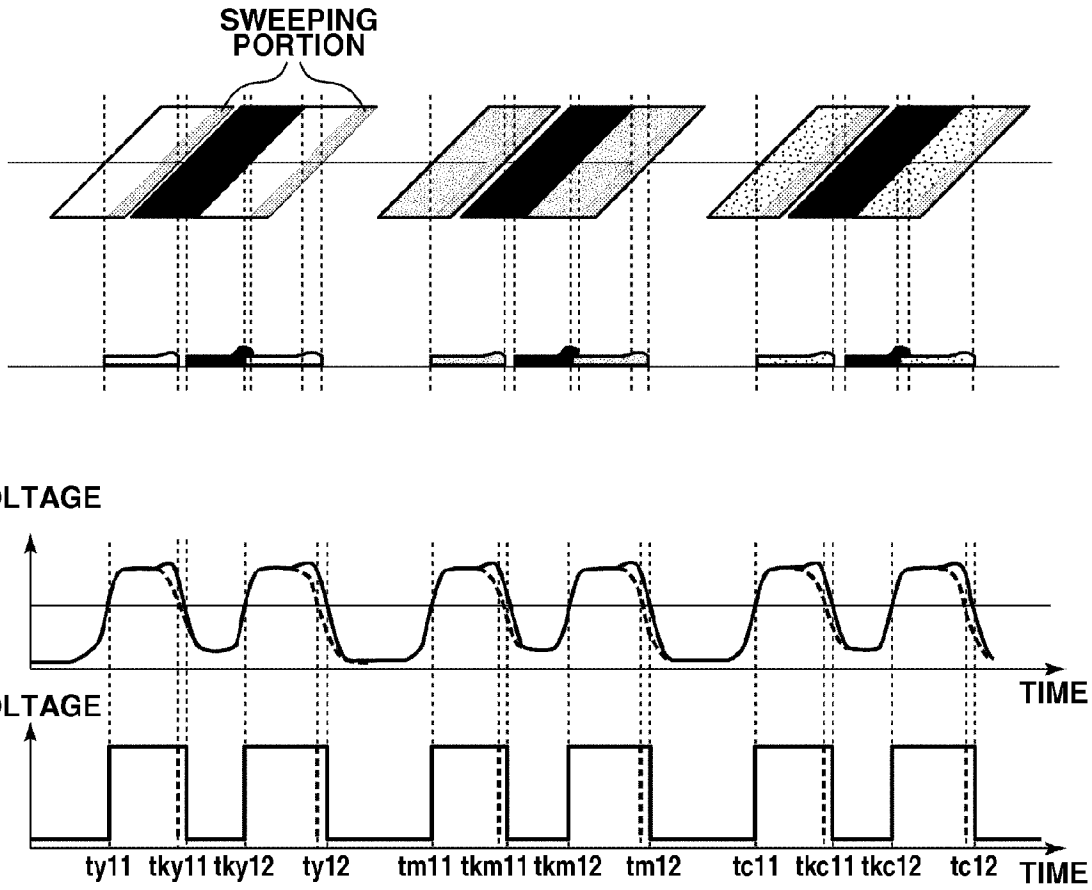
FIG.7A TOP VIEW OF POSITIONAL DEVIATION CORRECTION PATTERN
FIG.7B SECTIONAL VIEW OF POSITIONAL DEVIATION CORRECTION PATTERN
FIG.7C ANALOG OUTPUT SIGNAL
FIG.7D DIGITAL OUTPUT SIGNAL

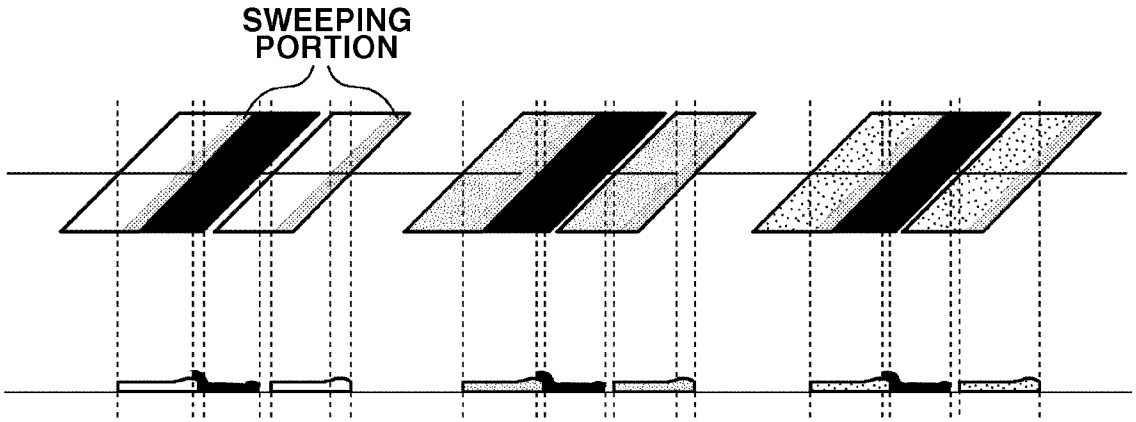
FIG.8A
TOP VIEW OF POSITIONAL DEVIATION CORRECTION PATTERN
FIG.8B
SECTIONAL VIEW OF POSITIONAL DEVIATION CORRECTION PATTERN
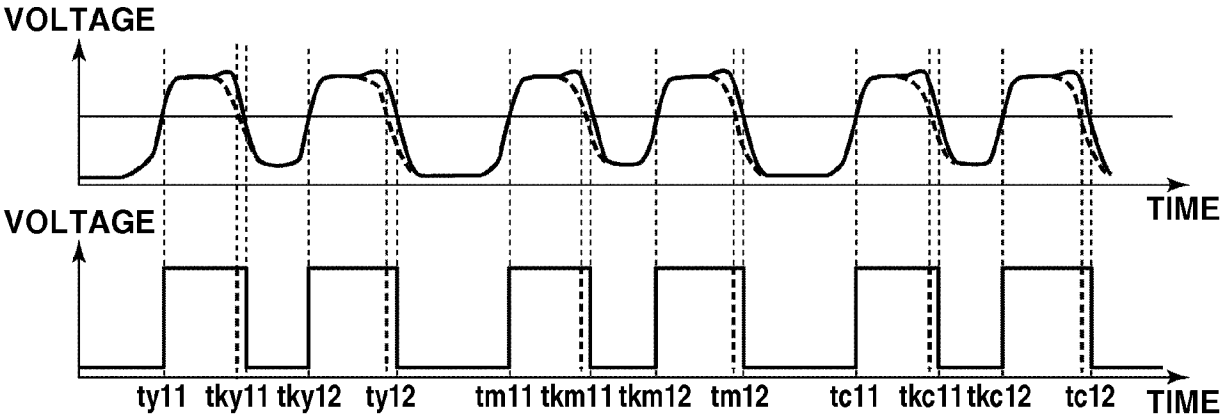
FIG.8C
ANALOG OUTPUT SIGNAL
FIG.8D
DIGITAL OUTPUT SIGNAL

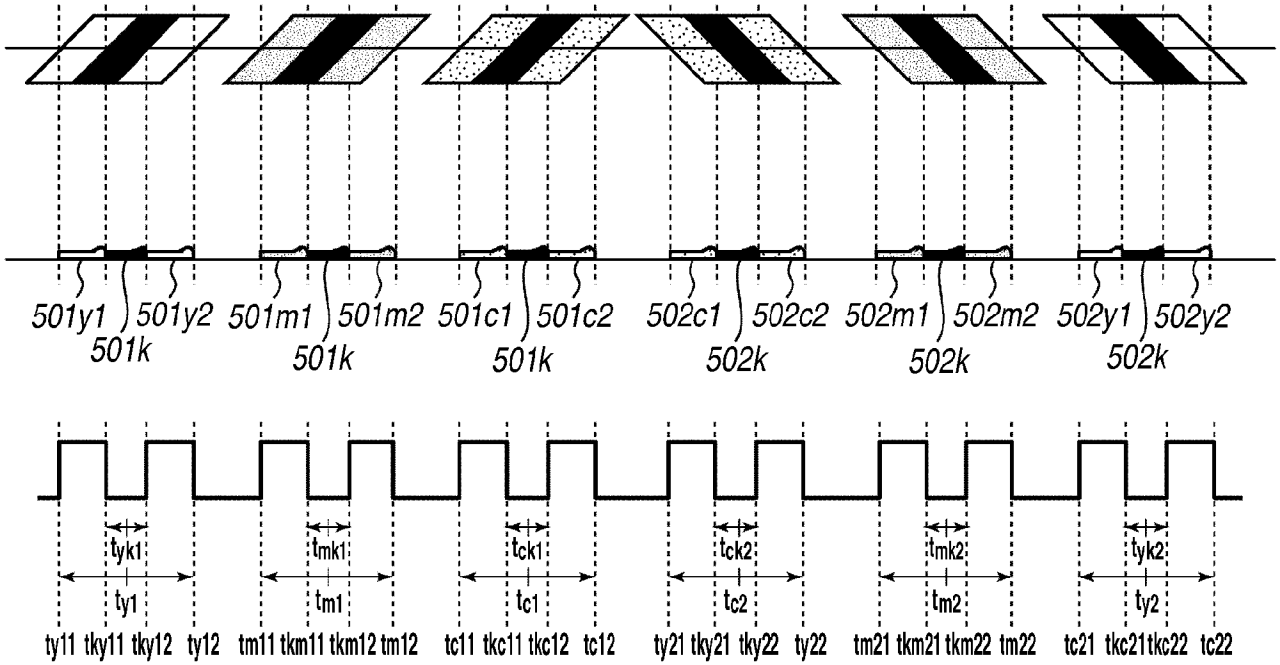
FIG.9A TOP VIEW OF POSITIONAL DEVIATION CORRECTION PATTERN
FIG.9B SECTIONAL VIEW OF POSITIONAL DEVIATION CORRECTION PATTERN
FIG.9C DIGITAL OUTPUT SIGNAL

TOP VIEW OF POSITIONAL DEVIATION CORRECTION PATTERN

SECTIONAL VIEW OF POSITIONAL DEVIATION CORRECTION PATTERN

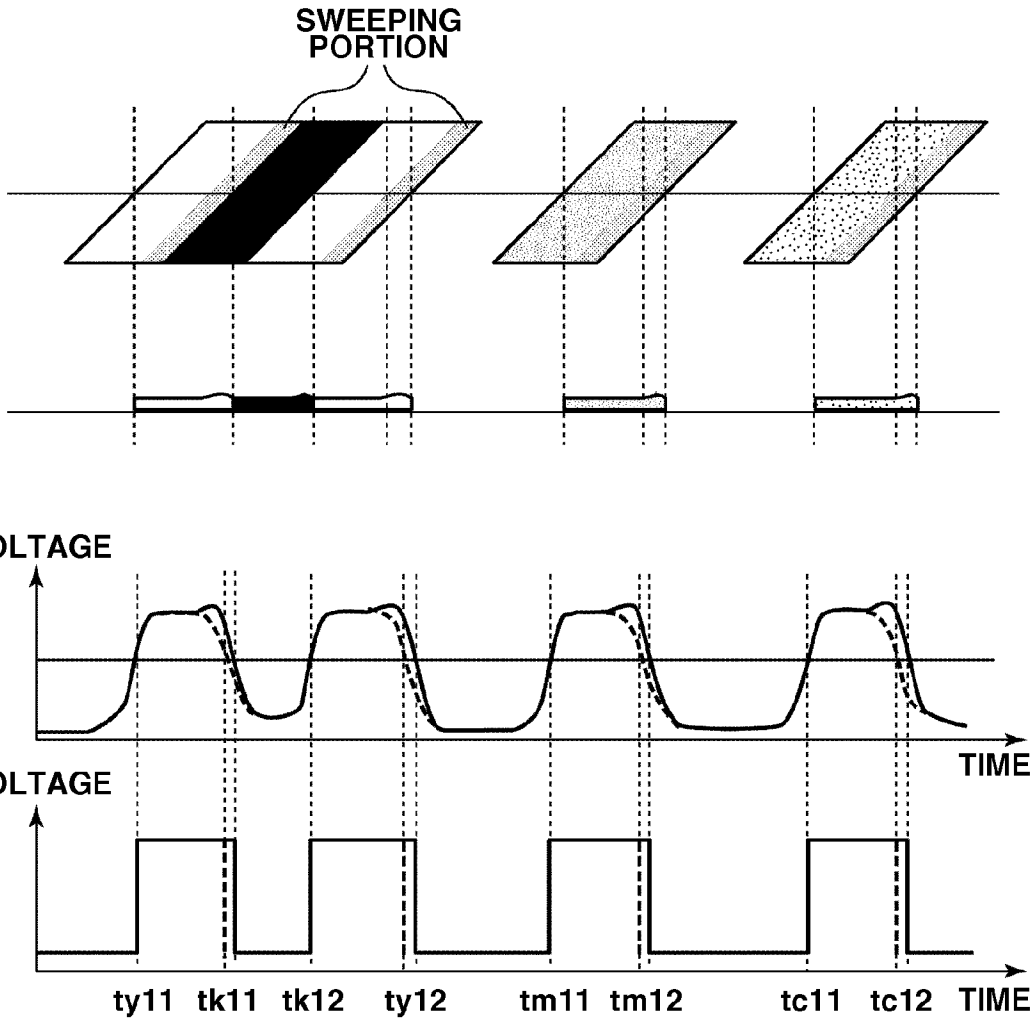
FIG.11A TOP VIEW OF POSITIONAL DEVIATION CORRECTION PATTERN
FIG.11B SECTIONAL VIEW OF POSITIONAL DEVIATION CORRECTION PATTERN
FIG.11C ANALOG OUTPUT SIGNAL
FIG.11D DIGITAL OUTPUT SIGNAL

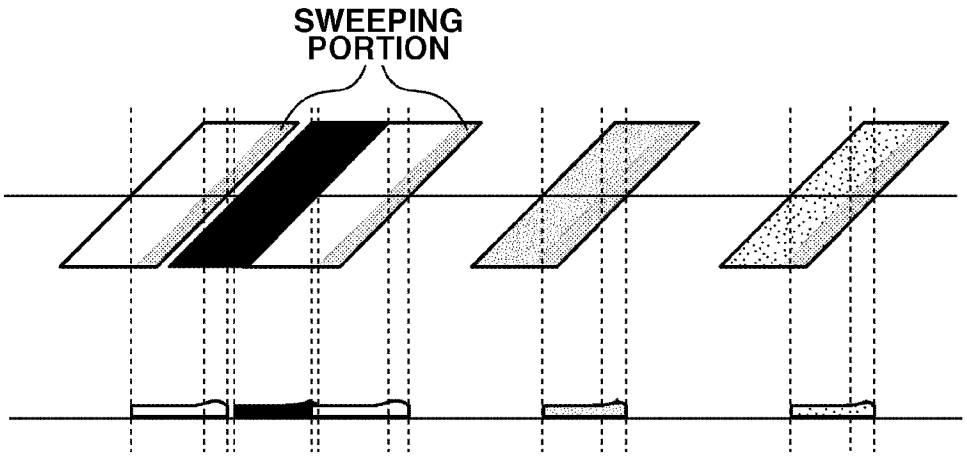
FIG.12A
TOP VIEW OF POSITIONAL DEVIATION CORRECTION PATTERN
FIG.12B
SECTIONAL VIEW OF POSITIONAL DEVIATION CORRECTION PATTERN
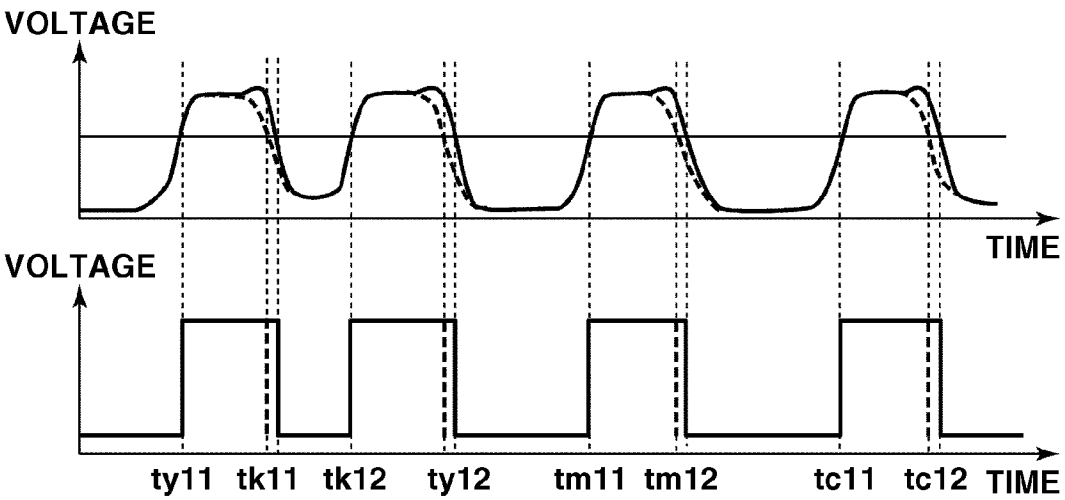
FIG.12C
ANALOG OUTPUT SIGNAL
FIG.12D
DIGITAL OUTPUT SIGNAL

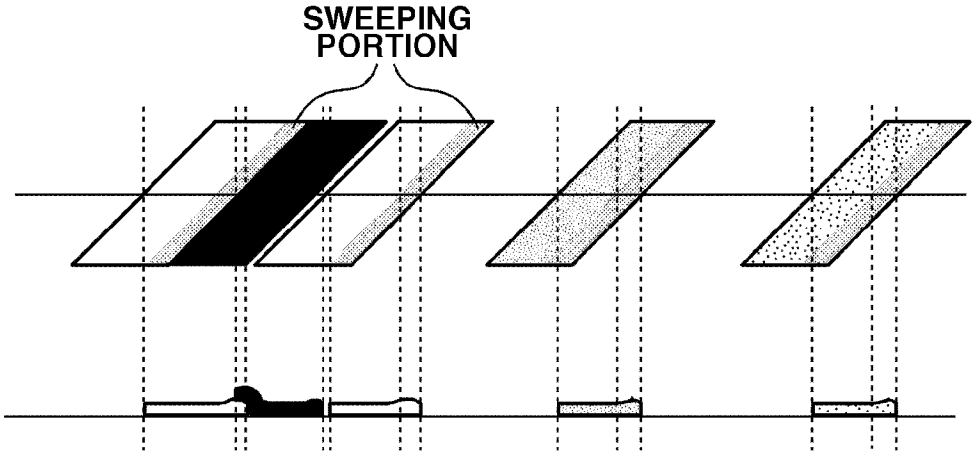
FIG.13A
TOP VIEW OF POSITIONAL DEVIATION CORRECTION PATTERN
FIG.13B
SECTIONAL VIEW OF POSITIONAL DEVIATION CORRECTION PATTERN
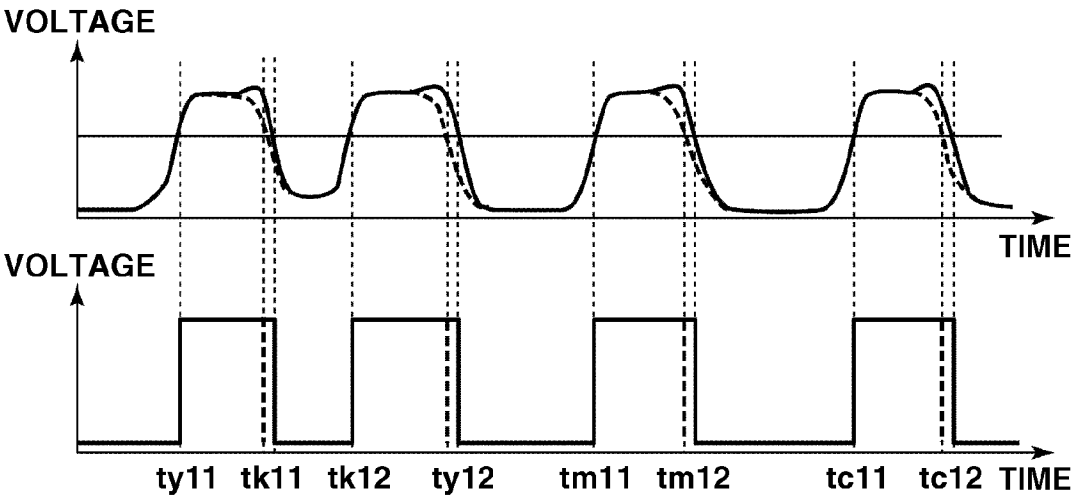
FIG.13C
ANALOG OUTPUT SIGNAL
FIG.13D
DIGITAL OUTPUT SIGNAL FIG.14A
TOP VIEW OF POSITIONAL DEVIATION CORRECTION PATTERN
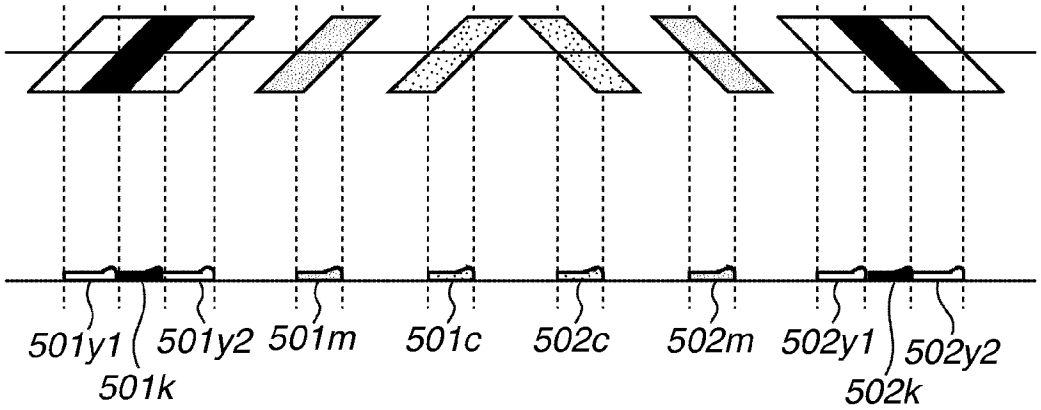
FIG.14B
SECTIONAL VIEW OF POSITIONAL DEVIATION CORRECTION PATTERN
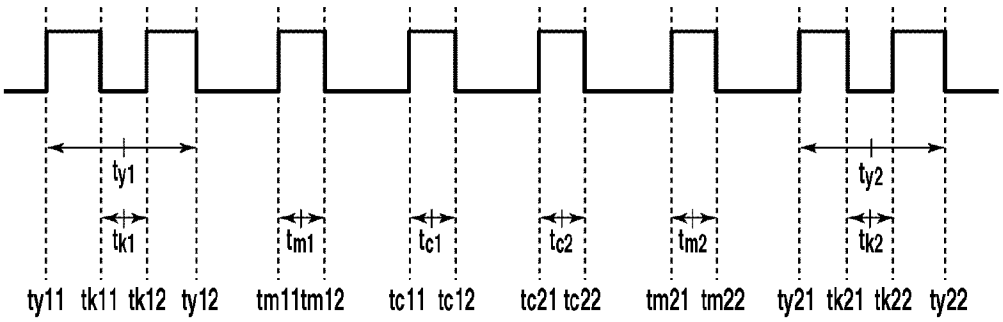
FIG.14C
DIGITAL OUTPUT SIGNAL (PRIOR ART)

TOP VIEW OF POSITIONAL DEVIATION CORRECTION PATTERN

SECTIONAL VIEW OF POSITIONAL DEVIATION CORRECTION PATTERN (PRIOR ART)
FIG.18A
TOP VIEW OF POSITIONAL DEVIATION CORRECTION PATTERN
FIG.18B
SECTIONAL VIEW OF POSITIONAL DEVIATION CORRECTION PATTERN
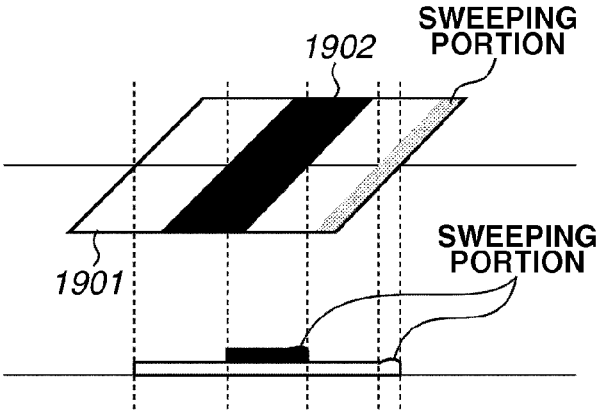
FIG.18C
ANALOG OUTPUT SIGNAL
FIG.18D
DIGITAL OUTPUT SIGNAL
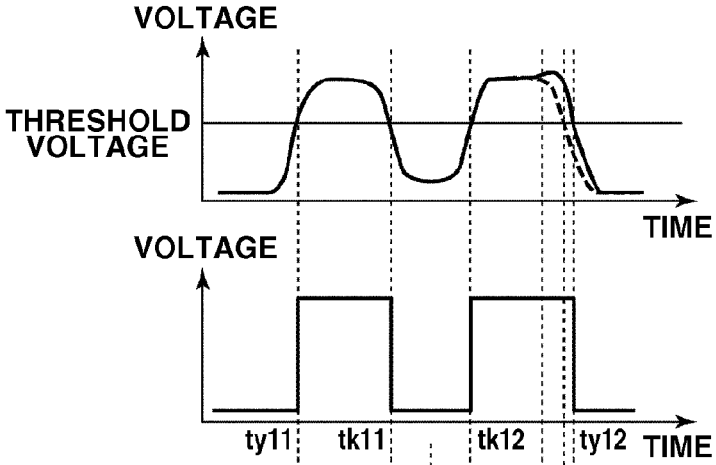
FIG.18E
THERE IS NO SWEEPING
FIG.18F
THERE IS SWEEPING
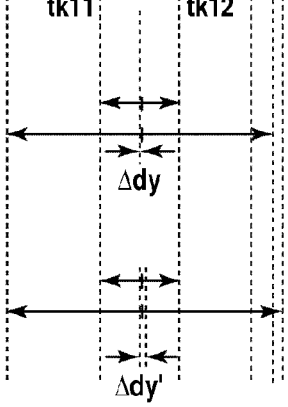

IMAGE FORMING APPARATUS FOR FORMING, DETECTING, AND CORRECTING SANDWICHED TONER PATTERN

BACKGROUND OF THE INVENTION

1. Field of the Invention

The present invention relates to an image forming apparatus such as a color laser printer, a color copying machine, or a color facsimile machine that mainly employs an electrophotographic process, and more particularly to alignment control of each color developer image formed on an image bearing member.

2. Description of the Related Art

Conventionally, in a color image forming apparatus including a plurality of photosensitive drums, positional deviation occurs between color images due to mechanical mounting error of the photosensitive drum, an optical path length error of each laser beam, or an optical path change. Thus, a method has been proposed to correct the positional deviation between the color images, in which a positional deviation correction pattern is produced on an intermediate transfer belt and the amount of position deviation (hereinafter referred to as "a positional deviation amount") between the color images is corrected by detecting the position of the positional deviation correction pattern.

Japanese Patent Application Laid-Open No. 2009-93155 discusses a detection method that uses a sensor for detecting the positional deviation correction pattern using a diffused light reflected from the deviation correction pattern.

When the positional deviation correction pattern is detected using diffused reflected light, an output value of diffused reflected light from a black developer formed on the intermediate transfer belt is reduced almost equally to that of the diffused reflection light from the intermediate transfer belt. Accordingly, as illustrated in FIGS. 15A and 15B, the positional deviation correction pattern is a pattern formed by using a pattern of a color developer as a base and superposing a pattern of black developer on the color developer.

In the examples shown in FIGS. 15A and 15B, black developer patterns 1604 are respectively superposed on a yellow developer pattern 1601, a magenta developer pattern 1602, and a cyan developer pattern 1603. Accordingly, the black developer pattern having limited diffused reflection light can be detected.

Japanese Patent Application Laid-Open No. 2007-272111 discusses a density increase that occurs at an image trailing edge during image formation in an electrophotographic process. Hereinafter, the occurrence of a density increase at the image trailing edge will be referred to as "sweeping".

Referring to FIG. 16, the mechanism by which sweeping occurs at the image trailing edge will be described. The amount of developed developer increases at a boundary on the downstream side of a latent image region 1703 on a photosensitive drum 1701. That is, at the boundary on the downstream side of a latent image region 1703, developer 1704 stuck to a developing roller 1702 facing the latent image region 1703 and a region on the downstream side of the facing position flies to the latent image region 1703 side with a low potential.

Thus, the amount of developer flying to the rotational-direction downstream side of the photosensitive drum 1701 is larger than that of developer in the latent image region 1703 other than the boundary on the downstream side, causing a sweeping phenomenon where the density of at the image trailing edge increases as illustrated in FIG. 17.

To reduce the sweeping amount, Japanese Patent Application Laid-Open No. 2007-272111 discusses a technique for extracting contour information from image information and setting, based on the extracted contour information, an image density of a region where sweeping is supposed to occur to be lower than that of original image data.

Such sweeping also occurs when a positional deviation correction pattern is formed on the intermediate transfer belt. When the sensor detects the positional deviation correction pattern where sweeping has occurred, the trailing edge of the positional deviation correction pattern cannot be correctly detected. Thus sweeping can cause errors in the detection of positional deviation.

For example, when a sensor configured to detect the positional deviation amount by using diffused reflected light is used, as illustrated in FIG. 18A, a positional deviation correction pattern is formed where a black developer pattern 1902 is superposed on a color development pattern 1901 as a base.

In this case, as illustrated in FIG. 18B, because of the influence of sweeping occurring at a pattern trailing edge, the deposition amount of developer at the pattern trailing edge increases to form a highly dense portion. Accordingly, as illustrated in FIG. 18C, in an analog output signal from a detection sensor, indicating a measure of the intensity of the diffused reflected light, the intensity of the trailing edge of a color developer pattern is higher than other positions on the pattern.

In the case of the black developer pattern, similar sweeping occurs at a pattern trailing edge. However, light is absorbed by the black developer itself reducing the amount of diffused reflected light from the developer. Thus, in an output value when the black developer pattern is detected by the sensor, the influence of sweeping is reduced.

The analog output signal from the sensor is binarized with a predetermined threshold value, and a positional deviation amount is calculated based on the timings of a rising edge and a falling edge of the binarized digital output signal. Specifically, as illustrated in FIG. 18D, the center position of the color developer pattern 1901 is calculated based on the timing ty 11 of the detection of the rising edge and the timing ty12 of the detection of the falling edge of the digital output signal.

Similarly, the center position of the black developer pattern is calculated based on the timing tk11 of the detection of the rising edge and the timing tk12 of the detection of the falling edge of the digital output signal. Then, a difference "Δ dy" between the center position of the color developer pattern and the center position of the black developer pattern is calculated as a relative positional deviation amount between the color developer pattern and the black developer pattern.

When no sweeping occurs, the analog signal output from the sensor and the digital output signal binarized with the threshold value are as indicated by broken lines illustrated in FIGS. 18C and 18D. Thus, for example, when there is no positional deviation between the color developer pattern and the black developer pattern, as illustrated in FIG. 18E, a positional deviation amount Δ dy is "0" (Δ dy=0).

However, when sweeping occurs, a highly dense portion is formed at the pattern trailing edge due to the sweeping. Thus, the analog signal output from the sensor and the digital output signal binarized with the threshold value are as indicated by solid lines illustrated in FIGS. 18C and 18D.

Thus, for example, even when there is no positional deviation between the color developer pattern and the black developer pattern, as illustrated in FIG. 18F, a positional deviation amount Δ dy' is not "0" (i.e. Δ dy'≠0), and erroneously detected as a positional deviation amount.

For example, the influence of the sweeping may be reduced by changing the setting of the image density as in the case of the technique discussed in Japanese Patent Application Laid-Open No. 2007-272111. However, this takes time and labor because one must predict how much sweeping occurs and a positional deviation detection pattern must be formed where the density is lowered accordingly.

When the influence of sweeping is not sufficiently reduced by prediction, the positional deviation amount Δ dy' is not "0" (Δ dy'≠0), and erroneously detected as a positional deviation amount.

Thus, when sweeping occurs during the formation of the conventional positional deviation correction pattern, an error occurs in the positional deviation amounts between the respective color images of the positional deviation correction patterns formed on the intermediate transfer belt. As a result, there is a problem in that when positional deviation is corrected, based on the output result of the sensor, correction accuracy is reduced due to the influence of the sweeping.

SUMMARY OF THE INVENTION

The present invention is directed to an image forming apparatus using a plurality of developers and capable of correcting positional deviation between color images formed on an image bearing member by suppressing the influence of sweeping to reduce accuracy.

According to an aspect of the present invention, an image forming apparatus includes an image forming unit configured to form developer images of a plurality of colors, a detection unit configured to detect reflected light when light is applied to a transfer medium on which the developer images have been formed by the image forming unit, and a control unit configured to correct, based on a detection result detected by the detection unit, timing of forming the developer images by the image forming unit, wherein when carrying out positional deviation detection, the control unit causes the image forming unit to form a positional deviation correction pattern, to sandwich one black developer image between two color developer images of a same color, and to superpose the one black developer image on one of the two color developer images of the same color in a state where color deviation occurs between developer images of a plurality of different colors.

Further features of the present invention will become apparent from the following description of exemplary embodiments with reference to the attached drawings.

BRIEF DESCRIPTION OF THE DRAWINGS

FIGS. 6A to 6D are diagrams illustrating examples of an analog output signal waveform and a digital output signal when the positional deviation correction patterns are detected by a sensor according to a first exemplary embodiment.

FIGS. 7A to 7D are diagrams illustrating a state where a black developer pattern is positionally shifted from a color developer pattern to the trailing edge side of a pattern forming direction according to the first exemplary embodiment.

FIGS. 8A to 8D are diagrams illustrating a state where the black developer pattern is positionally shifted from the color developer pattern to the leading edge side of the pattern forming direction according to the first exemplary embodiment.

FIGS. 9A to 9*c* are diagrams illustrating examples of an analog output signal waveform and a digital output signal when the positional deviation correction patterns are detected by the sensor according to the first exemplary embodiment.

FIGS. 11A to 11D are diagrams illustrating examples of an analog output signal waveform and a digital output signal when the positional deviation correction patterns are detected by a sensor according to the second exemplary embodiment.

FIGS. 12A to 12D are diagrams illustrating a state where a black developer pattern is positionally shifted from a color developer pattern to the trailing edge side of a pattern forming direction according to the second exemplary embodiment.

FIGS. 13A to 13D are diagrams illustrating a state where the black developer pattern is positionally shifted from the color developer pattern to the leading edge side of the pattern forming direction according to the second exemplary embodiment.

FIGS. 14A to 14*c* are diagrams illustrating examples of an analog output signal waveform and a digital output signal when the positional deviation correction patterns are detected by the sensor according to the second exemplary embodiment.

FIGS. 18A to 18F are diagrams illustrating examples of an analog output signal waveform and a digital output signal when the conventional positional deviation correction patterns are detected by a sensor.

DESCRIPTION OF THE EMBODIMENTS

Various exemplary embodiments, features, and aspects of the invention will be described in detail below with reference to the drawings. Each of the embodiments of the present invention described below can be implemented solely or as a combination of a plurality of the embodiments or features thereof where necessary or where the combination of elements or features from individual embodiments in a single embodiment is beneficial.

The exemplary embodiments described below are in no way limitative of the present invention according to the appended claims. Not all the combinations of the features of the exemplary embodiments are essential to the present invention.

<Image Forming Apparatus>

Figure 1:
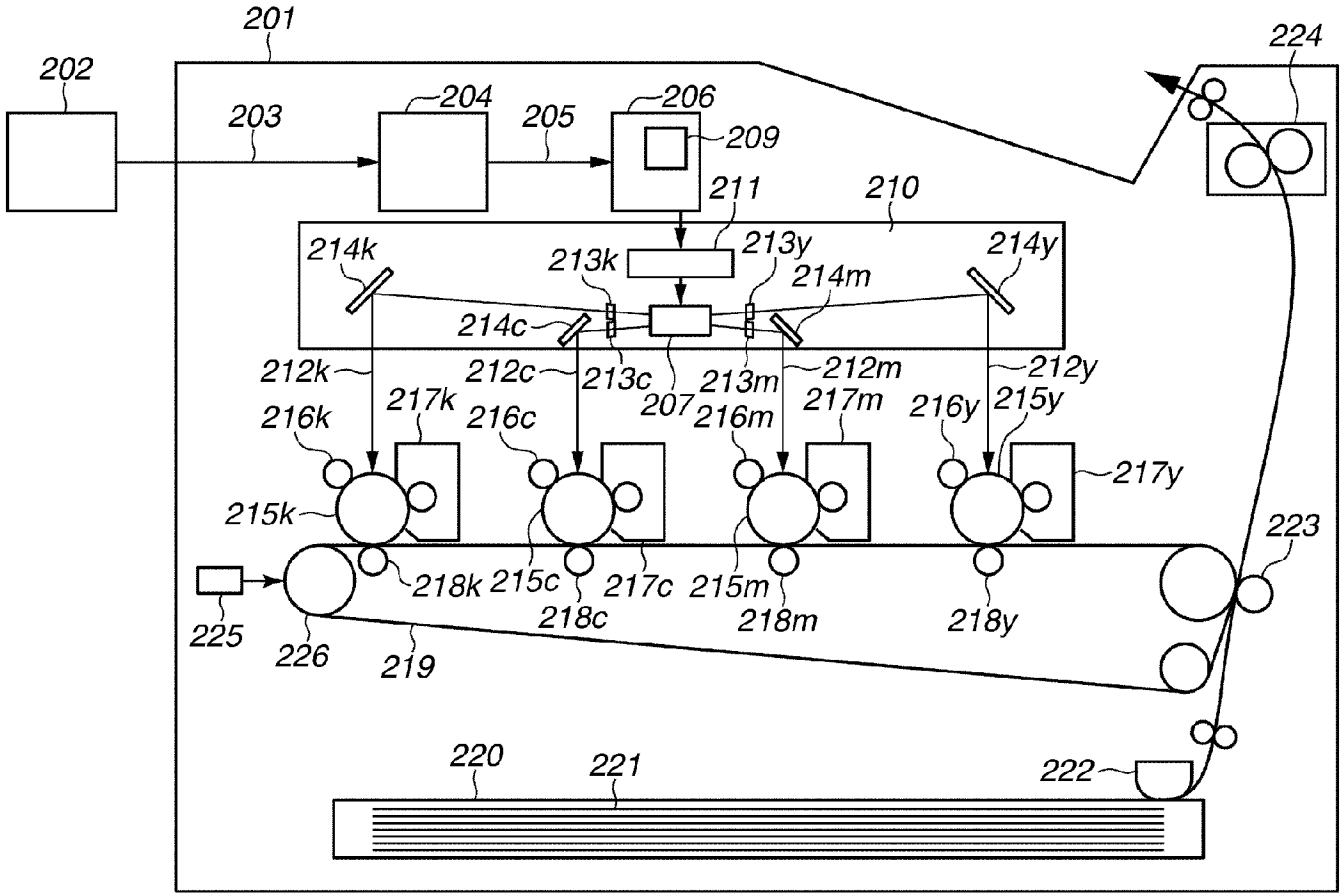
FIG. 1 is a schematic sectional diagram illustrating a configuration of a color laser printer that is an image forming apparatus.

FIG. 1 is a schematic sectional diagram illustrating a configuration of a color laser printer 201 that is an image forming apparatus according to an exemplary embodiment of the present invention. The image forming apparatus according to the present exemplary embodiment includes four-color image forming units to form a full-color image by combining four color images (Y: yellow, M: magenta, C: cyan, and Bk:

black). Developer images formed by the yellow, magenta, and the cyan developers are referred to as color developer images, and a developer image formed by the black developer is referred to as a black developer image.

The color laser printer 201, which has received image data 203 from a host computer 202, rasterizes the image data into video signal data by a print image generation unit 204 to generate a video signal 205 for image formation. A control unit 206, which includes a calculation unit such as a central processing unit (CPU) 209, receives the video signal 205 generated by the print image generation unit 204, and drives a plurality of laser diodes 211 provided in a scanner unit 210 as laser light emitting elements according to the video signal.

Laser beams 212*y*, 212*m*, 212*c*, and 212*k* (hereinbelow, referred to as laser beam 212) emitted from the laser diodes 211 are respectively applied to photosensitive drums 215*y*, 215*m*, 215*c*, and 215*k* (hereinbelow, referred to as photosensitive drum 215) via a polygon mirror 207, lenses 213*y*, 213*m*, 213*c*, and 213*k* (hereinbelow, referred to as lens 213), and folding mirrors 214*y*, 214*m*, 214*c*, and 214*k* (hereinbelow, referred to as folding mirror 214).

The photosensitive drums 215*y*, 215*m*, 215*c*, and 215*k* as a plurality of image bearing members are respectively charged by charging units 216*y*, 216*m*, 216*c*, and 216*k* (hereinbelow, referred to as charging unit 216).

The laser beam 212 is applied to the photosensitive drum 215 to partially lower its surface potential, and accordingly an electrostatic latent image is formed on a surface of the photosensitive drum 215. In the electrostatic latent image formed on the photosensitive drum 215 by the application of the laser beam 212, toner images (hereinbelow, referred to as developer images) are formed by developing units 217*y*, 217*m*, 217*c*, and 217*k* (hereinbelow, referred to as developing unit 217) according to the electrostatic latent image.

As described above, the image forming apparatus 201 includes image forming units for forming toner images of different colors on the photosensitive drums 215. The toner images formed on the photosensitive drums 215 are primarily transferred to an intermediate transfer belt 219 serving as a transfer medium by applying bias voltages to primary transfer members 218*y*, 218*m*, 218*c*, and 218*k* (hereinbelow, primary transfer member 218). The intermediate transfer belt 219 is an intermediate transfer member including a rotational endless belt.

First, a yellow image is primarily transferred to the intermediate transfer belt 219, and a magenta image, a cyan image, and a black image are sequentially transferred thereon to form a color image where toner images of a plurality of colors are superposed. Thus, the image forming apparatus 201 includes the primary transfer members 218 that are transfer units to sequentially transfer the toner images formed on the photosensitive drums 215 to the intermediate transfer belt 219 as the intermediate transfer member.

The intermediate transfer belt 219 is driven by an intermediate transfer belt driving roller 226. A recording material 221 in a cassette 220 is picked up by a feed roller 222, and conveyed to a secondary transfer unit to be synchronized with the image primarily transferred onto the intermediate transfer belt 219. Then, the secondary transfer unit carries out secondary transfer by a secondary transfer roller 223. Thus, the toner image is transferred to the recording material 221.

On the recording material 221 to which the toner image has been secondarily transferred, by a fixing unit 224, the toner image is thermally fixed by applying heat and pressure, and then discharged to a sheet discharge unit at the upper part of the image forming unit. A sensor unit 225 detects a positional deviation correction pattern for detecting a positional shifting amount between the color images transferred to the intermediate transfer belt 219.

The sensor unit 225 detects reflected light when light is applied to a positional deviation correction pattern of each color formed on the intermediate transfer belt 219, and transmits a detection result to the control unit 206. The control unit 206 calculates a position of the positional deviation correction pattern formed on the intermediate transfer belt 219 based on the detection result by the sensor unit 225, and corrects the positional deviations between the color images based on the calculated position of the positional deviation correction pattern of each color.

The transfer medium has been described as the intermediate transfer belt 219 as an example. However, the present invention is not limited thereto. The transfer medium can be a photosensitive drum, a recording material, or a conveyance belt for suctioning and conveying the recording material. Positional deviation detection can be carried out by detecting a correction pattern formed thereon.

<Configuration of Sensor Unit>

Figure 2:
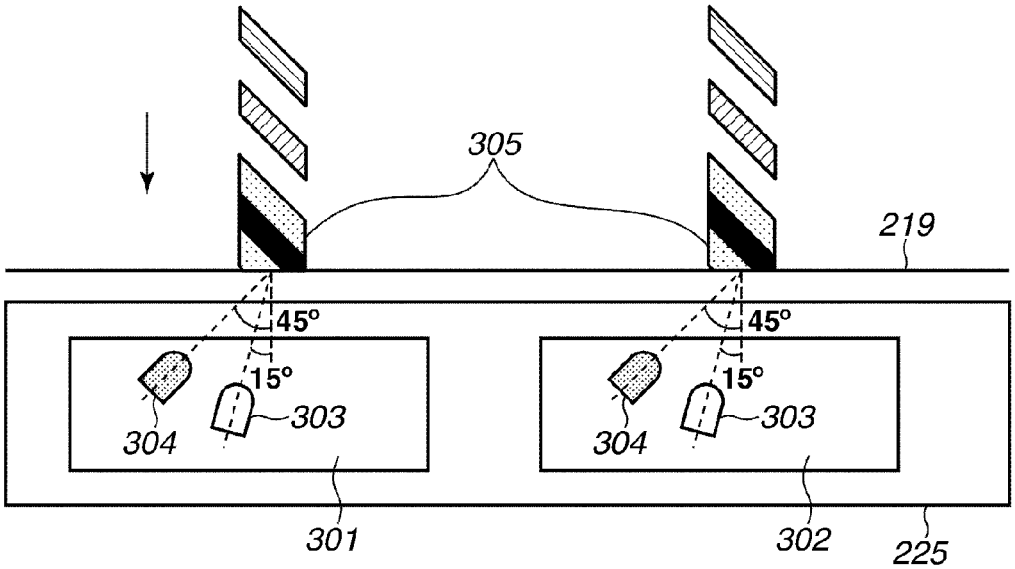
FIG. 2 is a schematic diagram illustrating a configuration of a sensor unit.

FIG. 2 is a schematic diagram illustrating a configuration of the sensor unit 225. The sensor unit 225 includes optical sensors 301 and 302. By arranging the optical sensors 301 and 302 in a direction orthogonal to a conveyance direction (arrow direction illustrated in FIG. 2) of the intermediate transfer belt 219, positional deviation detection of an image in a main scanning direction and positional deviation detection in a sub-scanning direction are carried out.

The optical sensors 301 and 302 detect diffused reflection light reflected from the intermediate transfer belt 219 and a positional deviation correction pattern 305. Each of the optical sensors 301 and 302 includes a light emitting element 303 and a light receiving element 304. The light emitting element 303 is disposed to emit infrared light at an angle of 15° to a vertical line direction of a belt surface of the intermediate transfer belt 219.

The light receiving element 304 is disposed at alight receiving angle of 45° with respect to the vertical line direction of the belt surface of the intermediate transfer belt 219 to detect the diffused reflection light reflected from the intermediate transfer belt 219 and the positional deviation correction pattern 305. The infrared light emitted from the light emitting element 303 is applied to the intermediate transfer belt 219 and the positional deviation correction pattern 305 of each color on the intermediate transfer belt 219. The light receiving element 304 receives the diffused reflection light of the infrared light from the intermediate transfer belt 219 and the positional deviation correction pattern on the intermediate transfer belt 219.

In the above-described example, the angle of the light emitting element 303 is 15°, and the angle of the light receiving element 304 is 45°. However, the angles are not limited thereto. Slight deviation is allowed from these angles according to positional deviation correction accuracy to be acquired. The light emitted from the light emitting element 303 is the infrared light. However, the light is not limited thereto. In other words, detection can be carried out by using color light other than the infrared light according to positional deviation correction accuracy to be acquired.

Figure 3:
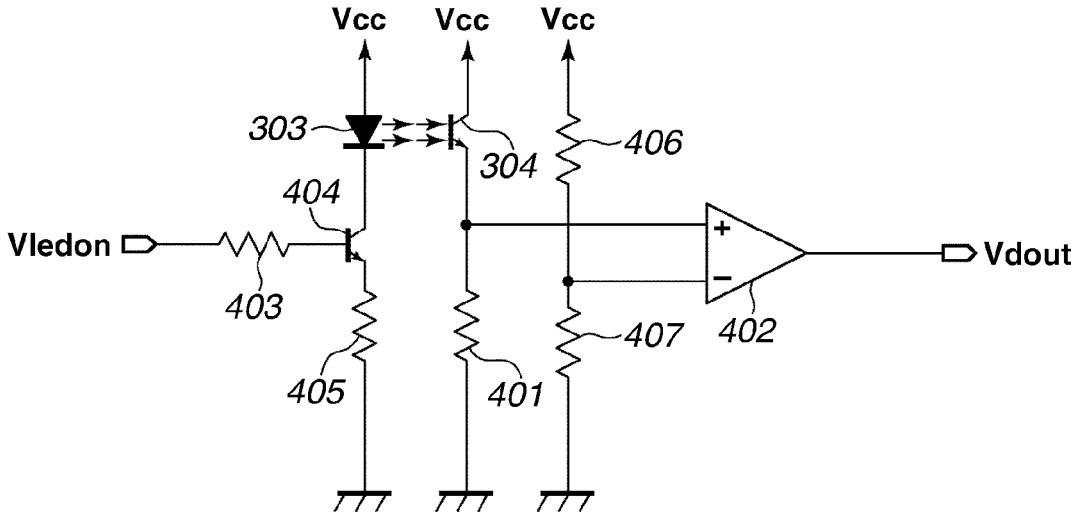
FIG. 3 is a diagram illustrating a driving circuit of the sensor unit.

FIG. 3 is a diagram illustrating a driving circuit of the sensor unit 225. The light emitting element 303 is controlled to be lit according to a light emitting element driving signal Vledon from the control unit 206. By the light emitting element driving signal Vledon, a switching element 404 such as a transistor is driven via a base resistor 403. Current flowing through the light emitting element 303 is controlled by a current limitation resistor 405, and accordingly emission control of the light emitting element 303 is carried out.

The light receiving element 304 receives the diffused reflection light reflected from the intermediate transfer belt 219 and the positional shifting correction pattern, and the current corresponding to the received diffused reflection light amount flows through a resistor 401. Thus, a detection value of the diffused reflection light amount is output as an analog output signal.

An analog output signal voltage indicating the detection value of the diffused reflection light amount is compared with a predetermined threshold value, which is determined by voltage dividing resistors 406 and 407, by a comparator 402, and thus the analog output signal is converted into a digital output signal Vdout. The control unit 206 time-sequentially captures the digital output signal Vdout, detects rising edge and falling edge timings of the digital output signal Vdout, and sequentially stores edge capturing timings in a storage device (not illustrated).

<Positional Deviation Correction Pattern>

Next, a configuration of a positional deviation correction pattern, an outline of a positional deviation correction pattern formed on the intermediate transfer belt 219 when positional deviation correction control is carried out, and a positional deviation correction method according to the present exemplary embodiment will be described.

Figures 4A, 4B:
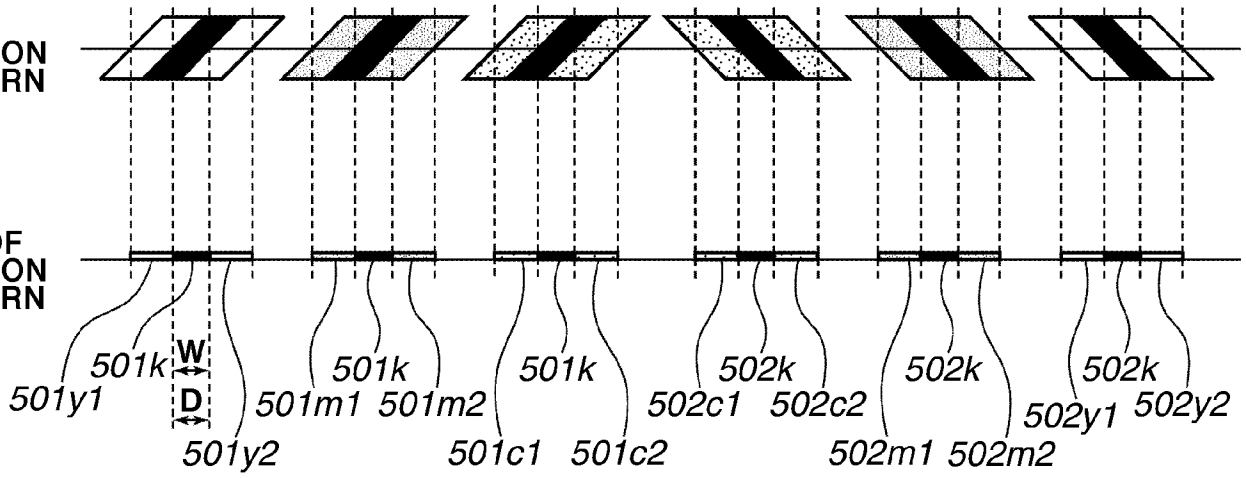
FIGS. 4A and 4B are diagrams illustrating a configuration example of one set of positional deviation correction patterns according to a first exemplary embodiment.

FIGS. 4A and 4B are diagrams illustrating a configuration example of positional deviation correction patterns according to the present exemplary embodiment. FIGS. 4A and 4B do not illustrate any sweeping.

The positional deviation correction pattern includes yellow developer patterns 501*y*1, 501*y*2, 502*y*1, and 502*y*2, magenta developer patterns 501*m*1, 501*m*2, 502*m*1, and 502*m*2, cyan developer patterns 501*c*1, 501*c*2, 502*c*1, and 502*c*2, and black developer patterns 501*k* and 502*k*.

As illustrated in FIGS. 4A and 4B, the positional deviation correction pattern is formed by reversing the downstream side patterns 502*y*1, 502*y*2, 502*m*1, 502*m*2, 502*c*1, 502*c*2, and 502*k* of respective colors formed on the downstream side in the conveyance direction with respect to the upstream side patterns 501*y*1, 501*y*2, 501*m*1, 501*m*2, 501*c*1, 501*c*2, and 501*k* of respective colors formed on the upstream side of the conveyance direction.

In the present exemplary embodiment, the patterns formed by the four color developers illustrated in FIGS. 4A and 4B are defined as one set of positional deviation correction patterns. Detecting a positional deviation amount between the color images of one set of positional deviation correction patterns by the sensor unit 225 enables detection of positional deviation amounts of the respective color patterns in the main scanning direction and the sub-scanning direction.

The positional deviation correction pattern according to the present exemplary embodiment is formed not by superposing one black developer pattern on one color developer pattern as in the conventional case but by adjacently forming one black developer pattern between two color developer patterns of the same colors.

Specifically, the black developer pattern 501*k* is formed between the yellow developer patterns 501*y*1 and 501*y*2. Similarly, the black developer pattern 501*k* is formed between the magenta developer patterns 501*m*1 and 501*m*2, and also between the cyan developer patterns 501*c*1 and 501*c*2.

Similarly, the black developer pattern 502*k* is formed between the cyan developer patterns 502*c*1 and 502*c*2, between the magenta developer patterns 502*m*1 and 502*m*2, and also between the yellow developer patterns 502*y*1 and 502*y*2.

A pattern width W of the black developer pattern is equal to a gap interval D from, among the color developer patterns sandwiching the black developer pattern, the trailing edge of the first pattern 501*y*1 to the leading edge of the second pattern 501*y*2.

If the black developer pattern width W is equal to the gap interval D, whatever value the width is, when positional deviation occurs, the color developer pattern and the black developer pattern are superposed on each other. However, it is not limited thereto, and for example, the pattern width W of the black developer pattern can be roughly equal to the gap interval D between the first pattern and the second pattern of the color developer pattern, i.e., different by about ±200 μm from the gap interval D, as a range permitted by positional deviation detection accuracy when positional deviation occurs.

In other words, the pattern width W of the black developer pattern does not need to be completely equal to the gap interval D between the two color developer patterns as long as one black developer pattern is superposed on one or both of two adjacent color developer patterns when color deviation occurs.

Further, a relationship between the pattern width W and the gap interval D is determined so that when color deviation occurs to cause the black developer pattern to be superposed on the color developer pattern on the upstream side of the conveyance direction, the width of sweeping occurring in the color developer pattern may be larger than a superposed width.

The example of the first pattern 501*y*1 and the second pattern 501*y*2 has been described above. However, the present invention is not limited thereto. For example, a similar relationship between the pattern width W and the gap interval D is established in any color combinations of magenta developer patterns 501*m*1 and 501*m*2, cyan developer patterns 501*c*1 and 501*c*2, yellow developer patterns 501*y*1 and 502*y*2, magenta developer patterns 502*m*1 and 502*m*2, and cyan developer patterns 502*c*1 and 502*c*2.

Figure 5:
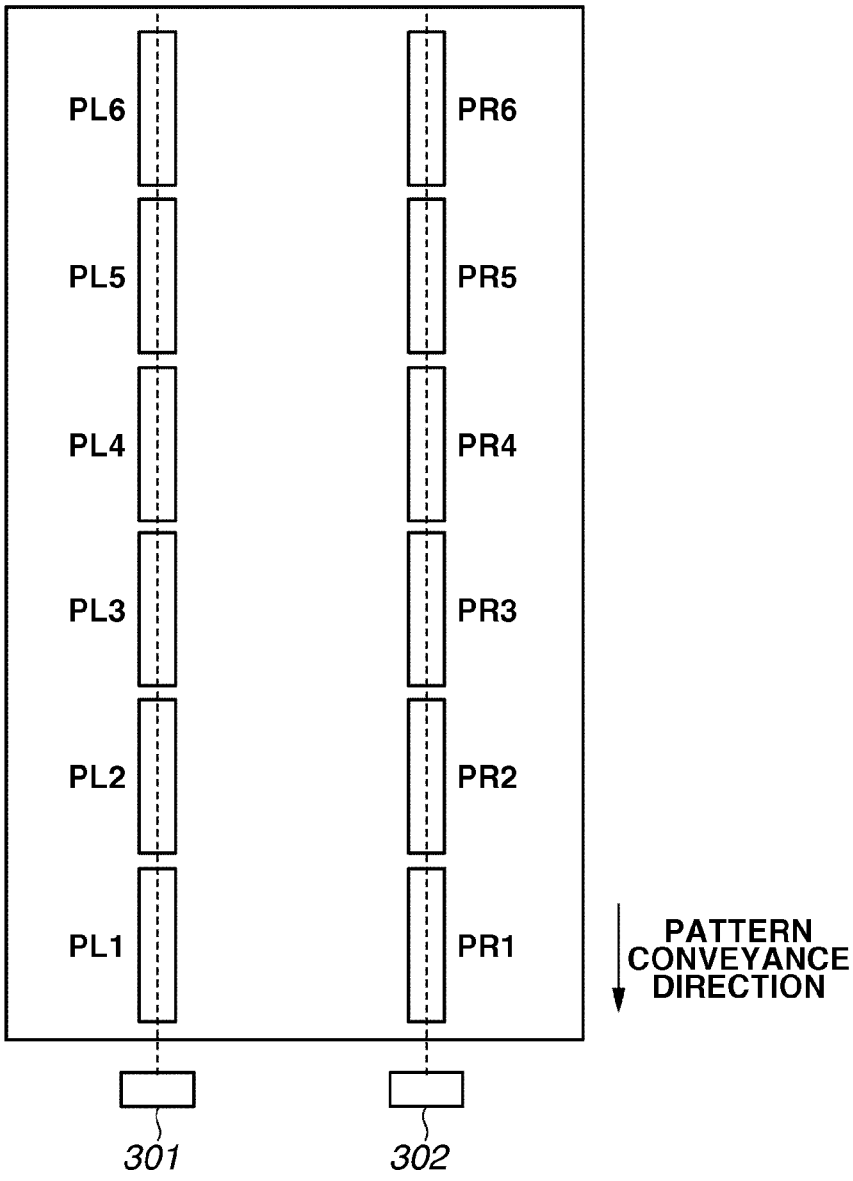
FIG. 5 is a development diagram illustrating an arrangement example of positional deviation correction patterns formed on an endless intermediate transfer belt.

FIG. 5 is a development diagram illustrating an arrangement example of positional deviation correction patterns formed on the endless intermediate transfer belt 219. In FIG. 5, each of positional deviation correction patterns PL1 to PL6 and PR1 to PR6 corresponds to one set of the positional deviation correction patterns illustrated in FIGS. 4A and 4B.

In the example illustrated in FIG. 5, totally 12 sets of positional deviation correction patterns are formed around the intermediate transfer belt 219: 6 sets (PL1 to PL6) for detection by the sensor 301 and 6 sets (PR1 to PR6) for detection by the sensor 302.

Accordingly, periodic unevenness of the photosensitive drums 215 and periodic unevenness of the intermediate transfer belt 219 can be canceled. The positional deviation correction patterns formed on the intermediate transfer belt 219 and conveyed in an arrow direction are sequentially detected by the sensors 301 and 302.

Next, referring to FIGS. 6A to 8D, the positional deviation correction patterns formed according to the present exemplary embodiment will be described. FIGS. 6A to 6D are diagrams illustrating examples of an analog output signal waveform and a digital output signal when the positional deviation correction patterns are detected by the sensor.

FIG. 6A is a top view of the positional deviation correction pattern, and FIG. 6B is a sectional view of the positional deviation correction pattern. FIG. 6C illustrates an example of an analog output signal waveform when the positional deviation correction pattern is detected by the sensor unit 225. FIG. 6D illustrates an example of a digital output signal waveform acquired by binarizing the detected analog output signal by the comparator according to a magnitude relationship with a threshold voltage.

As illustrated in FIG. 6C, the analog output signal output when the sensor unit 225 detects a color developer pattern is detected as a signal equal to or higher than a preset predetermined threshold voltage because there is much diffused reflection light from the color developer.

On the other hand, the analog output signal when the sensor unit 225 detects the black developer pattern or the intermediate transfer belt 219 is detected as a signal equal to or lower than the preset predetermined threshold voltage because diffused reflection light output from the color developer is limited. Thus, a boundary between the color developer pattern and the black developer pattern can be identified.

The detected analog output signal is binarized by the comparator according to a magnitude relationship with the threshold voltage to be converted into a digital output signal. The intermediate transfer belt 219 is generally formed by black or a color close to black. However, when the signal is output as a signal equal to or lower than the predetermined threshold voltage, the intermediate transfer belt 219 may be formed by other colors.

Based on the digital output signal illustrated in FIG. 6D, edges ty11, ty12, tm11, tm12, tc11, and tc12 of the color developer patterns of respective colors and edges tky11, tky12, tkm11, tkm12, tkc11, and tkc12 of the black developer patterns are detected as positional deviation correction pattern detection signals. The analog output signal and the digital output signal are detected as indicated by broken lines illustrated in 6C and 6D when no sweeping occurs.

On the other hand, when sweeping occurs, as indicated by solid lines illustrated in FIGS. 6C and 6D, outputs at pattern trailing edges are larger than those indicated by the broken lines. This is because when sweeping occurs at the positional deviation correction pattern, while there is no change in edge position of the trailing edge of the positional deviation correction pattern formed on the intermediate transfer belt 219, a density at the trailing edge is larger to increase the amount of reflected light detected by the sensor unit 225.

In other words, it is because a falling timing of the analog output signal is later by an amount equal to the increase of the amount of reflected light, and thus the trailing edge is detected later. Hereinbelow, a positional deviation detection method will be described by using an output value when a positional deviation detection pattern where sweeping occurs is detected.

<Positional Deviation Detection Method>

A method for calculating a positional deviation amount of each color based on a detection result of positional deviation correction pattern will be described. Calculation described below is carried out by the control unit 206. In the present exemplary embodiment, a positional deviation amount between the color images is calculated by acquiring a positional deviation amount between a reference color pattern and a measured color pattern.

As an example, a relative positional deviation amount between colors is calculated by setting a black developer pattern as a reference color pattern, and a yellow developer pattern, a magenta developer pattern, and a cyan developer pattern as measured color patterns.

FIGS. 6A to 6D illustrate a state where no relative color deviation occurs between the black developer pattern and the color developer pattern. Since no color deviation occurs, edges of the black developer patterns and the color developer patterns can be detected.

On the other hand, FIGS. 7A to 7D illustrate a state where relative color deviation occurs between the black developer pattern and the color developer pattern. Specifically, the black developer pattern and the color developer pattern formed at the trailing edge are superposed.

A gap is formed between the black developer pattern and the color developer pattern formed at the leading edge side to expose the intermediate transfer belt 219. In such a state, an edge at the leading edge side of the black developer pattern cannot be detected. This is because an output value output from the intermediate transfer belt 219 is lower than a threshold value before the leading edge of the black developer pattern is detected.

Accordingly, in such a case, an edge of the color developer pattern with the intermediate transfer belt 219 is detected as tky11.

FIGS. 8A to 8D illustrate a state where relative color deviation occurs between the black developer pattern and the color developer pattern. Specifically, the black developer pattern and the color developer pattern formed at the leading edge side are superposed.

A gap is formed between the black developer pattern and the color developer pattern formed at the trailing edge side to expose the intermediate transfer belt 219. In such a state, an edge at the trailing edge side of the black developer pattern cannot be detected.

This is because since the intermediate transfer belt 219 is exposed after the trailing edge of the black developer pattern, an output value output from the intermediate transfer belt 219 is lower than the threshold value following the trailing edge of the black developer pattern.

Accordingly, in such a case, an edge of the color developer pattern with the intermediate transfer belt 219 is detected as tky12.

Referring to FIGS. 9A to 9C, a method for calculating a positional deviation amount will be described. First, symbols in the digital output signal illustrated in FIG. 9A will be described. For convenience, the calculation method will be described by using, among the positional deviation correction patterns, one set for each of the colors as a representative. For the other positional deviation correction patterns, positional deviation amounts can be calculated by the same method.

FIGS. 9A to 9C illustrate patterns where no color deviation occurs as an example. However, by the same method, positional deviation amounts can be calculated when positional deviation occurs as in the case of those illustrated in FIGS. 7A to 7D and FIGS. 8A to 8D.

Leading edge position detection timing of first yellow developer pattern ty11, leading edge position detection timing of first black developer pattern tky11, trailing edge position detection timing of first black developer pattern tky12, trailing edge position detection timing of second yellow developer pattern ty12, leading edge position detection timing of first magenta developer pattern tm11, leading edge position detection timing of second black developer pattern tkm11, trailing edge position detection timing of second black developer pattern tkm12, trailing edge position detection timing of second magenta developer pattern tm12, leading edge position detection timing of first cyan developer pattern tc11, leading edge position detection timing of third black developer pattern tkc11, trailing edge position detection timing of third black developer pattern tkc12, and trailing edge position detection timing of second cyan developer pattern tc12.

Center positions of the respective color patterns are calculated by the following expressions using these detection timings.

Center position of yellow developer pattern ty1=(ty11+ty12)/2 (1)

Center position of magenta developer pattern tm1=(tm11+tm12)/2 (2)

Center position of cyan developer pattern tc1=(tc11+tc12)/2 (3)

Center position of black developer pattern sandwiched between yellow developer patterns tyk1=(tky11+tky12)/2 (4)

Center position of black developer pattern sandwiched between magenta developer patterns tmk1=(tkm11+tkm12)/2 (5)

Center position of black developer pattern sandwiched between cyan developer patterns tck1=(tkc11+tkc12)/2 (6)

Based on the calculated center positions of the patterns, positional deviation time of each pattern of the other colors in the sub-scanning direction with respect to the black developer pattern as a reference color is calculated by the following expressions. As described above referring to FIGS. 7A to 7D and FIGS. 8A to 8D, when positional deviation occurs, for an edge on the leading edge side or the trailing edge side of the black developer pattern, not the black developer pattern but the intermediate transfer belt 219 is detected.

Consequently, a width wider than an actual width of the black developer pattern is detected, and the center position of the black developer pattern is slightly shifted from an actual center position. In the expressions below, the deviation of the black developer pattern is corrected by doubling a difference in center position between the black developer pattern and the color developer pattern.

Sub-scanning position deviation time of yellow developer pattern PDt_yk=((tyk1−ty1)*2+(tyk2−ty2)*2)/2 (7)

Sub-scanning position deviation time of magenta developer pattern PDt_mk=((tmk1−tm1)*2+(tmk2−tm2)*2)/2 (8)

Sub-scanning position deviation time of yellow developer pattern PDt_ck=((tck1−tc1)*2+(tck2−tc2)*2)/2 (9)

Correction of the deviation of the black developer pattern can be performed by doubling the differences in the expressions (7), (8), and (9) will be described by taking a specific example. A specific example of calculating deviation time between the black developer pattern and the yellow developer pattern using the expression (7) will be described. For convenience, the center positions ty1 and ty2 of the yellow developer patterns are set to equal values, and the center positions tyk1 and tyk2 of the black developer patterns sandwiched by the yellow developer patterns are set to equal values.

It is supposed that a yellow developer pattern of the leading edge side is formed with a width of 3 dots from the 1st dot to the 3rd dot, a black developer pattern is formed with a width of 4 dots from the 4th to the 7th dot, and a yellow developer pattern of the trailing edge side is formed a width of 3 dots from the 8th dot to the 10th dot.

A specific positional deviation calculation method for (i) a state where no color deviation occurs, (ii) a superposed state of the black developer pattern and the color developer pattern formed on the trailing edge side, and (iii) a superposed state of the black developer pattern and the color developer pattern formed on the leading edge side in this status will be described.

(i) State where no color deviation occurs The center position of the yellow developer pattern is calculated by the expression (1). Since the leading edge position detection timing of the yellow developer pattern of the leading edge side is ty11=0 and the leading edge position detection timing of the yellow developer pattern of the trailing edge side is ty12=10, the center position of the yellow developer pattern is ty1=(ty11+ty12)/2=(0+10)/2=5, and thus ty 1=5 is set. Similarly, ty2=5 is set.

The center position of the black developer pattern is calculated by the expression (4). Since the leading edge position detection timing of the black developer pattern is tky11=3 and the trailing edge position detection timing of the black developer pattern is tky12=7, the center position of the black developer pattern sandwiched between the yellow developer patterns is tyk1=(tky11+tky12)/2=(3+7)/2=5, and thus tyk 1=5 is set. Similarly, tyk2=5 is set.

By substituting the expression (7) with this result, sub-scanning positional deviation time of the yellow developer pattern is PDt_yk=((tyk1−ty1)*2+(tyk2−ty2)*2)/2=(5−5)*2+(5−5)*2)/2=0. Accordingly, a value indicating no occurrence of color deviation can be calculated.

(ii) Superposed state of the black developer pattern and the color developer pattern formed on the trailing edge side A state where the black developer pattern and the yellow developer pattern on the downstream side are superposed by 1 dot will be described supposing that a yellow developer pattern of the leading edge side is formed with a width of 3 dots from the 1st dot to the 3rd dot, a black developer pattern is formed with a width of 4 dots from the 5th to the 8th dot, and a yellow developer pattern of the trailing edge side is formed a width of 3 dots from the 8th dot to the 10th dot.

The center position of the yellow developer pattern is calculated by the expression (1). Since the leading edge position detection timing of the yellow developer pattern of the leading edge side is ty11=0 and the leading edge position detection timing of the yellow developer pattern of the trailing edge side is ty12=10, the center position of the yellow developer pattern is ty1=(ty11+ty12)/2=(0+10)/2=5, and thus ty1=5 is set. Similarly, ty2=5 is set.

The center position of the black developer pattern is calculated by the expression (4). Since the black developer pattern is shifted to the downstream side by 1 dot, there is no developer at the 3rd dot, thus the intermediate transfer belt is exposed.

In this state, the timing of detecting the intermediate transfer belt is detected to be a boundary between the yellow developer pattern and the black developer pattern. Accordingly, the leading edge position detection timing of the black developer pattern is tky11=3 and the trailing edge position detection timing of the black developer pattern is tky12=8. In other words, while formed by 4 dots in practice, the black developer pattern is detected as a pattern of 5 dots. Thus, the center position of the black developer pattern is that of the black developer pattern sandwiched between the yellow developer patterns tyk1=(tky11+tky12)/2=(3+8)/2=5.5, and thus tyk 1=5.5 is set. Similarly, tyk2=5.5 is set.

By substituting the expression (7) with this result, sub-scanning positional deviation time of the yellow developer pattern is PDt_yk=((tyk1−ty1)*2+(tyk2−ty2)*2)/2=(5.5−5)*2+(5.5−5)*2)/2=1. Accordingly, by doubling the difference, 1-dot occurrence of black developer pattern deviation can be calculated.

(iii) Superposed state of the black developer pattern and the color developer pattern formed on the leading edge side A state where the black developer pattern and the yellow developer pattern on the upstream side are superposed by 1 dot will be described supposing that a yellow developer pattern of the leading edge side is formed with a width of 3 dots from the 1st dot to the 3rd dot, a black developer pattern is formed with a width of 4 dots from the 3th to the 6th dot, and a yellow developer pattern of the trailing edge side is formed a width of 3 dots from the 8th dot to the 10th dot.

The center position of the yellow developer pattern is calculated by the expression (1). Since the leading edge position detection timing of the yellow developer pattern of the leading edge side is ty11=0 and the leading edge position detection timing of the yellow developer pattern of the trailing edge side is ty12=10, the center position of the yellow developer pattern is ty1=(ty11+ty12)/2=(0+10)/2=5, and thus ty 1=5 is set. Similarly, ty2=5 is set.

The center position of the black developer pattern is calculated by using the expression (4). Since the black developer pattern is shifted to the upstream side by 1 dot, there is no developer at the 7th dot, thus the intermediate transfer belt is exposed.

In this state, the timing of detecting the yellow developer pattern of the trailing is obtained to be a boundary between the yellow developer pattern and the black developer pattern. Accordingly, the leading edge position detection timing of the black developer pattern is tky11=2 and the trailing edge position detection timing of the black developer pattern is tky12=7.

In other words, while formed by 4 dots in practice, the black developer pattern is detected as a pattern of 5 dots. Thus, the center position of the black developer pattern is that of the black developer pattern sandwiched between the yellow developer patterns tyk1=(tky11+tky12)/2=(2+7)/2=4.5, and thus tyk 1=4.5 is set. Similarly, tyk2=4.5 is set.

By substituting the expression (7) with this result, sub-scanning positional deviation time of the yellow developer pattern is PDt_yk=((tyk1−ty1)*2+(tyk2−ty2)*2)/2=(4.5−5)*2+(4.5−5)*2)/2=1. Accordingly, by doubling the difference, 1-dot occurrence of black developer pattern deviation can be calculated.

The example method for correcting the error of the black developer pattern by doubling the calculated difference has been described above. However, the present invention is not limited thereto. For example, a correction table corresponding to a value not doubling the difference may be created, and a value referred to in the table can be set as sub-scanning direction positional deviation time of each color.

Time corresponding to each of the leading edge position, the trailing edge position, and the center position of each color pattern indicates time elapsed from reference time (e.g., timer measurement starting time). The control unit 206 calculates, by converting calculated positional deviation time into a positional deviation amount by using a speed PS of the intermediate transfer belt 219, relative positional deviation amounts of the other color patterns with respect to the black developer pattern as a reference color by using the following expressions:

sub-scanning position deviation amount of yellow developer pattern PDd1_yk=PS×PDt_yk (10)

sub-scanning position deviation amount of magenta developer pattern PDd1_mk=PS×PDt_mk (11)

sub-scanning position deviation amount of cyan developer pattern PDd1_ck=PS×PDt_ck (12)

The control unit 206 carries out the calculation for each one set of positional deviation correction patterns, and calculates an average of all the sets of positional deviation correction patterns to calculate relative positional deviation amounts of sub-scanning writing positions of the other color patterns with respect to the black developer pattern as the reference color.

When the calculated positional deviation amounts PDd1_yk, PDd1_mk, and PDd1_ck are positive values, writing of the measured colors (yellow, magenta, and cyan) is later with respect to the reference color (black). On the other hand, when the positional deviation amounts PDd1_yk, PDd1_mk, and PDd1_ck are negative values, writing of the measured colors is earlier with respect to the reference color.

The control unit 206 calculates, based on the calculated center positions of the patterns, main-scanning direction positional deviation times of the other color patterns with respect to the black developer pattern as the reference color by using the following expressions.

As described above referring to FIGS. 7A to 7D and FIGS. 8A to 8D, when positional deviation occurs, for an edge on the leading edge side or the trailing edge side of the black developer pattern, not the black developer pattern but the intermediate transfer belt 219 is detected. Consequently, a width wider than an actual width of the black developer pattern is detected, and the center position of the black developer pattern is slightly shifted from an actual center position.

In the expressions below, the deviation of the black developer pattern is corrected by doubling a difference in center position between the black developer pattern and the color developer pattern.

Main scanning position deviation time of yellow developer pattern SDt_yk=((ty1−tyk1)*2−(ty2−tyk2)*2)/2 (13)

Main scanning position deviation time of magenta developer pattern SDt_mk=((tm1−tmk1)*2−(tm2−tmk2)*2)/2 (14)

Main scanning position deviation time of cyan developer pattern SDt_ck=((tc1−tck1)*2−(tc2−tck2)*2)/2 (15)

The example method for correcting the error of the black developer pattern by doubling the calculated difference has been described above. However, the present invention is not limited thereto. For example, a correction table corresponding to a value not doubling the difference can be created, and a value referred to in the table can be set as main scanning direction positional deviation time of each color.

Time corresponding to each of the leading edge position, the trailing edge position, and the center position of each color pattern indicates time elapsed from reference time (e.g., timer measurement starting time). The control unit 206 calculates, by converting the calculated positional deviation time into a positional deviation amount by using the speed PS of the intermediate transfer belt 219, relative positional deviation amounts of the other color patterns with respect to the black developer pattern as a reference color by using the following expressions:

Main scanning position deviation amount of yellow developer pattern SDd1_yk=PS×SDt_yk (16)

Main scanning position deviation amount of magenta developer pattern SDd1_mk=PS×SDt_mk (17)

Main scanning position deviation amount of cyan developer pattern SDd1_ck=PS×SDt_ck (18)

The control unit 206 carries out the calculation for each set of positional deviation correction patterns, and calculates an average of all the sets of positional deviation correction patterns to calculate relative positional deviation amounts of main scanning writing positions of the other color patterns with respect to the black developer pattern as the reference color.

When the calculated positional deviation amounts SDd1_yk, SDd1_mk, and SDd1_ck are positive values, writing of the measured colors (yellow, magenta, and cyan) is later with respect to the reference color (black). On the other hand, when the positional deviation amounts SDd1_yk, SDd1_mk, and SDd1_ck are negative values, writing of the measured colors is earlier with respect to the reference color.

Thus, different from the conventional case where one black developer pattern is superposed on one color developer pattern to detect positional deviation, one black developer pattern and two color developer patterns of the same color are arranged side by side, and one black developer pattern is sandwiched between the two color developer patterns.

Thus, sweeping occurs in the pattern disposed on the leading edge side and the pattern disposed on the trailing edge side in the conveyance direction of the intermediate transfer belt 219 of the color developer pattern.

Because of the sweeping in the color developer pattern disposed on the leading edge side, the timing of detecting the leading edge of the black developer pattern is delayed. Similarly, because of the sweeping in the color developer pattern disposed on the trailing edge side, the timing of detecting the trailing edge of the color developer pattern is delayed.

Thus, the center position of the color developer pattern and the center position of the black developer pattern are affected by the sweeping to shift to the trailing edge side. As a result, since the sweeping in the color developer pattern of the leading edge side and the sweeping in the color developer pattern of the trailing edge side cause deviation of similar levels in detection of the center position of the black developer pattern and detection of the center position of the color developer pattern, the influence of the sweeping when the center position of the black developer pattern is compared with the center position of the color developer pattern can be canceled.

As a result, positional deviation between the color images formed on the image bearing members can be corrected by suppressing reduction of accuracy caused by the influence of sweeping.

In the first exemplary embodiment, the method for correcting the positional deviation by forming the black developer pattern between the color developer patterns, has been described. In the second exemplary embodiment, a method for correcting positional deviation by forming a black developer pattern between arbitrary color developer patterns of one color, will be described. Description of components similar to those of the first exemplary embodiment is omitted.

<Positional Deviation Correction Pattern>

Figures 10A, 10B:
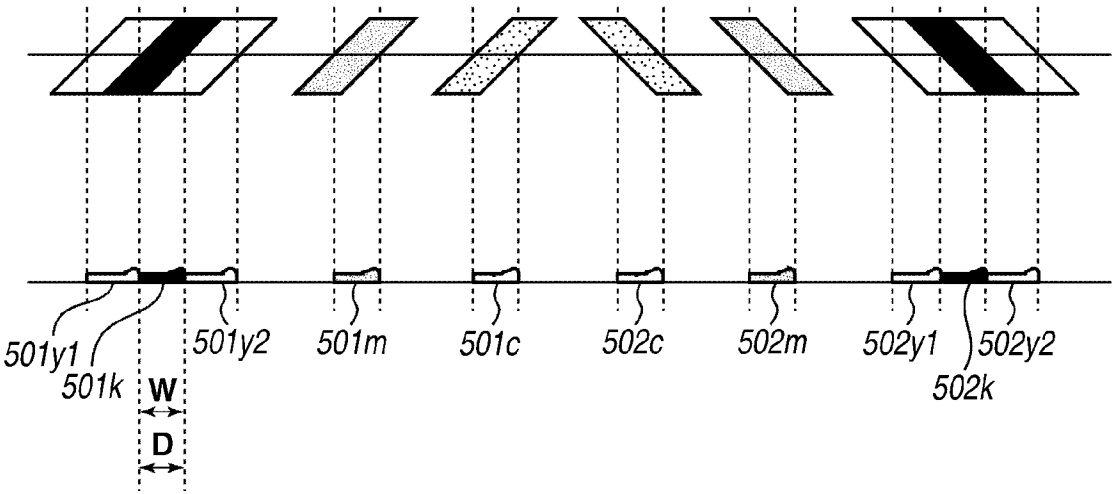
FIGS. 10A and 10B are diagrams illustrating a configuration example of one set of positional deviation correction patterns according to a second exemplary embodiment.
Figures 15A, 15B:
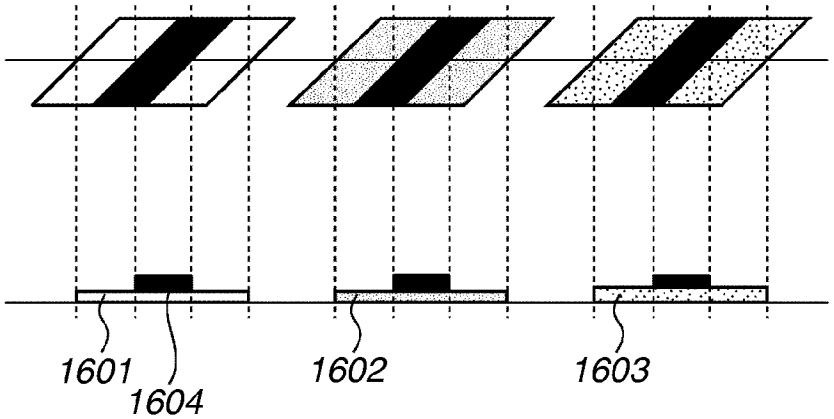
FIGS. 15A and 15B are diagrams illustrating conventional positional deviation correction patterns.
Figure 16:
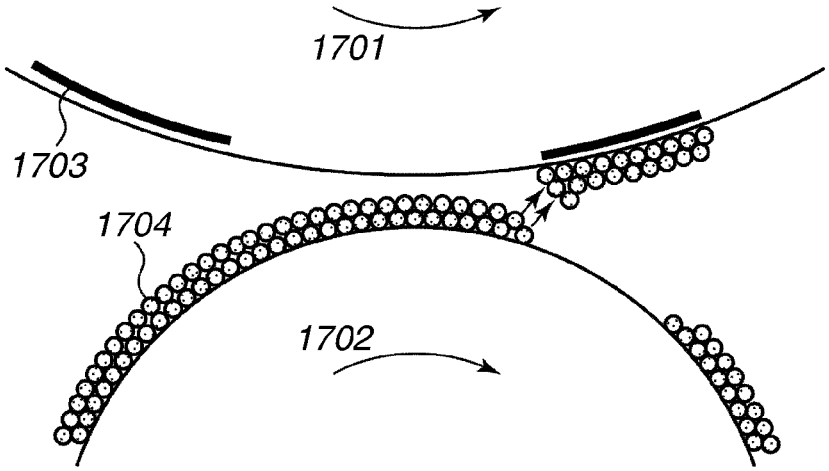
FIG. 16 is a diagram illustrating a mechanism of a sweeping occurrence.
Figure 17:
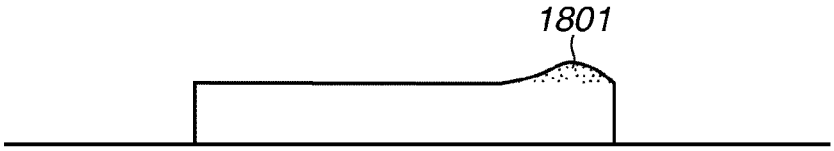
FIG. 17 is a diagram illustrating sweeping occurring at an image trailing edge.

FIGS. 10A and 10B are diagrams illustrating a configuration example of positional deviation correction patterns according to the present exemplary embodiment. The positional deviation correction pattern includes yellow developer patterns 501*y*1, 501*y*2, 502*y*1, and 502*y*2, magenta developer patterns 501*m* and 502*m*, cyan developer patterns 501*c* and 502*c*, and black developer patterns 501*k* and 502*k*.

As illustrated in FIGS. 10A and 10B, the positional deviation correction pattern is formed by reversing the downstream side patterns 502*y*1, 502*y*2, 502*m*, 502*c*, and 502*k* of respective colors formed on the downstream side of a conveyance direction with respect to the upstream side patterns 501*y*1, 501*y*2, 501*m*, 501*c*, 501*c*, and 501*k* of respective colors formed on the upstream side of the conveyance direction.

In the present exemplary embodiment, the patterns formed by four color developers illustrated in FIGS. 10A and 10B are defined as one set of positional deviation correction patterns.

Detecting a positional deviation amount between the color images of one set of positional deviation correction patterns by a sensor unit 225 enables detection of positional deviation amounts of the respective color patterns in a main scanning direction and a sub-scanning direction.

The positional deviation correction pattern according to the present exemplary embodiment is formed not by superposing one black developer pattern on one color developer pattern as in the conventional case but by adjacently forming one black developer pattern between two color developer patterns of the same colors.

To form much more positional deviation correction patterns on one circumference of an intermediate transfer belt 219, a black developer pattern 501*k* is formed between the yellow developer patterns 501*y*1 and 501*y*2.

Each of the magenta developer pattern and the cyan developer pattern is formed as one pattern without sandwiching any black developer pattern. The black developer patterns are formed to be sandwiched by the yellow developer pattern as an example. However, the black developer pattern can be sandwiched between the magenta developer patterns or cyan developer patterns.

As in the case of the first exemplary embodiment, a pattern width W of the black developer pattern is equal to a gap interval D from, among the color developer patterns sandwiching the black developer pattern, the trailing edge of the first pattern 501*y*1 to the leading edge of the second pattern 501*y*2.

If the black developer pattern width W is equal to the gap interval D, whatever value the width is, when positional deviation occurs, the color developer pattern and the black developer pattern are superposed on each other.

However, it is not limited thereto, for example, the pattern width W of the black developer pattern can be roughly equal to the gap interval D between the first pattern and the second pattern of the color developer pattern, i.e., different by about ±200 μm from the gap interval D, as a range permitted by positional deviation detection accuracy when positional deviation occurs.

In other words, the pattern width W of the black developer pattern does not need to be completely equal to the gap interval D between the two color developer patterns as long as one black developer pattern is superposed on one or both of two adjacent color developer patterns when color deviation occurs.

Further, a relationship between the pattern width W and the gap interval D is determined so that when color deviation occurs to cause the black developer pattern to be superposed on the color developer pattern on the upstream side of the conveyance direction, a width of sweeping occurring in the color developer pattern may be larger than a superposed width.

The example of the first pattern 501*y*1 and the second pattern 501*y*2 has been described above. However, the present invention is not limited thereto. For example, a similar relationship between the pattern width W and the gap interval D is established in any combinations of 502*y*1 and 501*y*2. The example where the yellow developer patterns sandwich the black developer pattern has been described above. However, a similar relationship is established when the magenta developer patterns or the cyan developer patterns sandwich the black developer pattern.

As in the case of the first exemplary embodiment, a plurality of sets of positional deviation correction patterns illustrated in FIGS. 10A and 10B is formed within one circumference of the intermediate transfer belt 129 so that periodic unevenness of the photosensitive drums 215 and periodic unevenness of the intermediate transfer belt 219 can be canceled. The positional deviation correction patterns are sequentially detected by the sensor unit 225.

<Positional Deviation Detection Method>

A method for calculating a positional deviation amount of each color based on a detection result of positional deviation correction pattern according to the present exemplary embodiment will be described. Calculation described below is carried out by the control unit 206. In the present exemplary embodiment, a positional deviation amount between the color images is calculated by acquiring a positional deviation amount between a reference color pattern and a measured color pattern. As an example, a relative positional deviation amount between colors is calculated by setting a yellow developer pattern as a reference color pattern and a black developer pattern, a magenta developer pattern, and a cyan developer pattern as measured color patterns.

Referring to FIGS. 11A to 13D, positional deviation correction patterns formed in the present exemplary embodiment will be described.

FIGS. 11A to 11D illustrate a state where no relative color deviation occurs between the yellow developer pattern and the black developer pattern. Since no color deviation occurs, edges of the black developer pattern and the yellow developer pattern can be detected.

On the other hand, FIGS. 12A to 12D illustrate a state where relative color deviation occurs between the black developer pattern and the yellow developer pattern. Specifically, the black developer pattern and the color developer pattern formed at the trailing edge are superposed.

A gap is formed between the black developer pattern and the yellow developer pattern formed at the leading edge side to expose the intermediate transfer belt 219. In such a state, an edge at the leading edge side of the black developer pattern cannot be detected.

This is because an output value output from the intermediate transfer belt 219 is lowered before the leading edge of the black developer pattern is detected. Accordingly, in such a case, an edge of the yellow developer pattern with the intermediate transfer belt 219 is detected as tk11.

FIGS. 13A to 13D illustrate a state where relative color deviation occurs between the black developer pattern and the color developer pattern. Specifically, the black developer pattern and the yellow developer pattern formed at the leading edge side are superposed together.

A gap is formed between the black developer pattern and the yellow developer pattern formed at the trailing edge side to expose the intermediate transfer belt 219. In such a state, an edge at the trailing edge side of the black developer pattern cannot be detected.

This is because an output value is lowered by the intermediate transfer belt 219 before the leading edge of the black developer pattern is detected. Accordingly, in such a case, an edge of the yellow developer pattern with the intermediate transfer belt 219 is detected as tk12.

Referring to FIGS. 14A to 14C, a method for calculating a positional deviation amount will be described. First, symbols in a digital output signal illustrated in FIG. 14C will be described. For convenience, the calculation method will be described by using, among the positional deviation correction patterns, one set for each of the colors as a representative.

For the other positional deviation correction patterns, positional deviation amounts can be calculated by the same method. FIGS. 14A to 14C illustrate patterns where no color deviation occurs as an example. However, by the same method, positional deviation amounts can be calculated when positional deviation occurs as in the case illustrated in FIGS. 12A to 12D and FIGS. 13A to 13D.

Leading edge position detection timing of first yellow developer pattern ty11, leading edge position detection timing of first black developer pattern tk11, trailing edge position detection timing of first black developer pattern tk12, trailing edge position detection timing of second yellow developer pattern ty12, leading edge position detection timing of first magenta developer pattern tm11, trailing edge position detection timing of second magenta developer pattern tm12, leading edge position detection timing of first cyan developer pattern tc11, and trailing edge position detection timing of second cyan developer pattern tc12.

Center positions of the respective color patterns are calculated by using the following expressions using these detection timings.

$$\text{Center position of yellow developer pattern } ty1 = (ty11+ty12)/2 \quad (19)$$

$$\text{Center position of magenta developer pattern } tm1 = (tm11+tm12)/2 \quad (20)$$

$$\text{Center position of cyan developer pattern } tc1 = (tc11+tc12)/2 \quad (21)$$

$$\text{Center position of black developer pattern } tk1 = (tk11+tk12)/2 \quad (22)$$

Based on the calculated center positions of the patterns, positional deviation time of each pattern of the other colors in the sub-scanning direction with respect to the yellow developer pattern as a reference color is calculated by the following expressions. As described above in the first exemplary embodiment, when positional deviation occurs, for an edge on the leading edge side or the trailing edge side of the black developer pattern, not the black developer pattern but the intermediate transfer belt 219 is detected.

Consequently, a width wider than an actual width of the black developer pattern is detected, and the center position of the black developer pattern is slightly shifted from an actual center position. In the expressions below, the deviation of the black developer pattern is corrected by doubling a difference in center position between the black developer pattern and the yellow developer pattern as in the case of the first exemplary embodiment.

The magenta developer pattern and the cyan developer pattern are not formed to sandwich the black developer pattern. Thus, since there is no need to correct deviation of the black developer pattern, the difference is not doubled.

$$\text{Sub-scanning position deviation time of magenta developer pattern } PDt_my = ((tm1-ty1)+(tm2-ty2))/2 \quad (23)$$

$$\text{Sub-scanning position deviation time of cyan developer pattern } PDt_cy = ((tc1-ty1)+(tc2-ty2))/2 \quad (24)$$

Sub-scanning position deviation time of black developer pattern PDt_ky=((tk1−ty1)*2+(tk2−ty2)*2)/2 (25)

The example method for correcting the error of the black developer pattern by doubling the calculated difference has been described above. However, the present invention is not limited thereto. For example, a correction table corresponding to a value not doubling the difference can be created, and a value referred to in the table can be set as sub-scanning direction positional deviation time of each color.

Time corresponding to each of the leading edge position, the trailing edge position, and the center position of each color pattern indicates time elapsed from reference time (e.g., timer measurement starting time). The control unit 206 calculates, by converting the calculated positional deviation time into a positional deviation amount by using the speed PS of the intermediate transfer belt 219, relative positional deviation amounts of the other color patterns with respect to the yellow developer pattern as a reference color by using the following expressions:

sub-scanning position deviation amount of magenta developer pattern PDd1_my=PS×PDt_my (26)

sub-scanning position deviation amount of cyan developer pattern PDd1_cy=PS×PDt_cy (27)

sub-scanning position deviation amount of black developer pattern PDd1_ky=PS×PDt_ky (28)

The control unit 206 carries out the calculation for each one set of positional deviation correction patterns, and calculates an average of all the sets of the positional deviation correction patterns to calculate relative positional deviation amounts of sub-scanning writing positions of the other color patterns with respect to the yellow developer pattern as the reference color.

When the calculated positional deviation amounts PDd1_my, PDd1_cy, and PDd1_ky are positive values, writing of the measured colors (magenta, cyan, and black) is delayed with respect to the reference color (yellow).

On the other hand, when the positional deviation amounts PDd1_my, PDd1_cy, and PDd1_ky are negative values, writing of the measured colors is earlier with respect to the reference color.

The control unit 206 calculates, based on the calculated center positions of the patterns, main-scanning direction positional deviation time of each of the other color patterns with respect to the black developer pattern as the reference color.

In the present exemplary embodiment, the magenta developer pattern and the cyan developer pattern are not formed to be sandwiched by the yellow developer patterns set as the reference for positional deviation correction. Thus, when main-scanning direction positional deviation time of each of the magenta developer pattern and the cyan developer pattern with respect to the yellow developer pattern is calculated, positional deviation time between the colors is calculated based on nominal time tcy_ref, tmy_ref of detection timing calculated between the patterns from a nominal distance between the yellow developer pattern and the magenta developer pattern and a nominal distance between the yellow developer pattern and the cyan developer pattern.

Main scanning position deviation time of magenta developer pattern SDt_my=((tm1−tmy_ref)−(tm2+tmy_ref))/2 (29)

Main scanning position deviation time of cyan developer pattern SDt_cy=((tc1−tcy_ref)−(tc2+tcy_ref)/2 (30)

Main scanning position deviation time of black developer pattern SDt_ky=((tk1−ty1)*2−(tk2−ty2)*2)/2 (31)

The example method for correcting the error of the black developer pattern by doubling the calculated difference has been described above. However, the present invention is not limited thereto. For example, a correction table corresponding to a value not doubling the difference can be created, and a value referred to in the table can be set as main scanning direction positional deviation time of each color.

Time corresponding to each of the leading edge position, the trailing edge position, and the center position of each color pattern indicates time elapsed from reference time (e.g., timer measurement starting time). The control unit 206 calculates, by converting the calculated positional deviation time into a positional deviation amount by using the speed PS of the intermediate transfer belt 219, relative positional deviation amounts of the other color patterns with respect to the yellow developer pattern as a reference color by using the following expressions:

Main scanning position deviation amount of magenta developer pattern SDd1_my=PS×SDt_my (32)

Main scanning position deviation amount of cyan developer pattern SDd1_cy=PS×SDt_cy (33)

Main scanning position deviation amount of black developer pattern SDd1_ky=PS×SDt_ky (34)

The control unit 206 carries out the calculation for each one set of positional deviation correction patterns, and calculates an average of all the sets of the positional deviation correction patterns to calculate relative positional deviation amounts of main scanning writing positions of the other color patterns with respect to the yellow developer pattern as the reference color.

When the calculated positional deviation amounts SDd1_my, SDd1_cy, and SDd1_ky are positive values, writing of the measured colors (magenta, cyan, and black) is later with respect to the reference color (yellow).

On the other hand, when the positional deviation amounts SDd1_my, SDd1_cy, and SDd1_ky are negative values, writing of the measured colors is earlier with respect to the reference color.

Thus, according to the present exemplary embodiment, forming one black developer pattern to be sandwiched between two color developer patterns of one arbitrary color enables arrangement of much more positional deviation correction patterns within one circumference of the intermediate transfer belt 219.

Thus, as in the case of the first exemplary embodiment, different from the conventional case where one black developer pattern is superposed on one color developer pattern to detect positional deviation, one black developer pattern and two color developer patterns of the same color are arranged side by side, and one black developer pattern is sandwiched between the two color developer patterns.

Thus, sweeping occurs in the pattern disposed on the leading edge side and the pattern disposed on the trailing edge side in the conveyance direction of the intermediate transfer belt 219 of the color developer pattern. Because of the sweeping in the color developer pattern disposed on the leading edge side, the timing of detecting the leading edge of the black developer pattern is delayed.

Similarly, because of the sweeping in the color developer pattern disposed on the trailing edge side, the timing of detecting the trailing edge of the color developer pattern is delayed. Thus, the center position of the color developer pattern and the center position of the black developer pattern are affected by the sweeping to shift to the trailing edge side.

As a result, since the sweeping in the color developer pattern of the leading edge side and the sweeping in the color developer pattern of the trailing edge side cause deviation of similar levels in detection of the center position of the black developer pattern and detection of the center position of the color developer pattern, the influence of the sweeping when the center position of the black developer pattern is compared with the center position of the color developer pattern can be canceled.

As a result, positional deviation between the color images formed on the image bearing members can be corrected by suppressing reduction of accuracy caused by the influence of sweeping.

Each of the exemplary embodiments has been described by taking the examples where the positional deviation correction pattern is formed on the intermediate transfer belt 219 to be detected. However, the present invention is not limited thereto. For example, positional deviation correction can be carried out by forming and detecting a correction pattern on the recording material 221.

According to each of the exemplary embodiments, the image forming apparatus is configured in such a manner that the developer image is primarily transferred from the photosensitive drum 215 to the intermediate transfer belt 219 and the developer image on the intermediate transfer belt 219 is secondarily transferred to the recording material 221.

However, the present invention is not limited thereto. For example, the image forming apparatus can include a transfer unit for directly transferring the developer image from the photosensitive drum 215 to the recording material 221. In this case, the sensor unit 225 detects a position deviation correction pattern formed on the recording material 221.

According to each of the exemplary embodiments, the position of the photosensitive drum 215 is fixed, and the intermediate transfer belt 219 is moved. The developer images of the respective colors are accordingly transferred to the intermediate transfer belt 219 at different positions. Thus, developer images of a plurality of colors are formed. However, the image forming apparatus can be configured in such a manner that a plurality of photosensitive drums 215 is sequentially switched to form a developer image of each color.

According to the configuration of the present invention, in the image forming apparatus using the developers of the plurality of colors, positional deviation between the color images formed on the image bearing member can be corrected by suppressing reduction of accuracy caused by the influence of sweeping While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-131297 filed Jun. 8, 2012, which is hereby incorporated by reference herein in its entirety.

What is claimed is:

1. An image forming apparatus comprising:

an image forming unit configured to form a positional deviation correction pattern including developer images of a plurality of colors on an image bearing member;

a detection unit configured to emit light to the positional deviation correction pattern formed by the image forming unit and to detect reflected light from the positional deviation correction pattern; and a control unit configured to perform positional deviation correction based on the detected result by the detection unit, wherein the control unit is configured to cause the image forming unit to form the positional deviation correction pattern such that one black developer image is disposed between two color developer images of a same color, and not whole of the one black developer image but a part thereof is superimposed, in a direction perpendicular to a surface of the image bearing member, on either of the two color developer images of a same color in a state where positional deviation occurs between developer images of a plurality of different colors, wherein a sweeping in the color developer images occurs at a downstream edge in a conveyance direction of a transfer medium on which the color developer images are formed, wherein a timing to detect the edge of the color developer images in the detected result obtained by the detection unit is affected by a detection error due to the sweeping, and wherein the control unit obtains a center position of the two color developer images of a same color and a center position of the one black developer image based on the detected result detected by the detection unit, and cancels the detection error by obtaining a positional deviation amount based on the center position of the two color developer images of a same color and a center position of the one black developer image.

2. The image forming apparatus according to claim 1, wherein the control unit is arranged to cause the image forming unit to form the positional deviation correction pattern such that the black developer image is prevented from being superposed on one of the two color developer images of the same color in a state where no positional deviation occurs between the developer images of the plurality of different colors.

3. The image forming apparatus according to claim 1, wherein the control unit is arranged to cause the image forming unit to form the positional deviation correction pattern such that a width of sweeping occurring in a color developer image is larger than a superposed width of the black developer image on one of the two color developer images of the same color in a state where positional deviation occurs between the developer images of the plurality of different colors.

4. The image forming apparatus according to claim 1, wherein the control unit is configured to calculate, based on the detection result detected by the detection unit, positional deviation amounts of the developer images of other colors with respect to a developer image of a predetermined reference color, and performs the positional deviation correction based on the positional deviation amounts.

5. The image forming apparatus according to claim 4, wherein the control unit is configured to calculate the positional deviation amounts corresponding to a value acquired by doubling a difference in center position between the developer image of the predetermined reference color and the developer images of the other colors.

6. The image forming apparatus according to claim 4, wherein the control unit is configured to calculate the positional deviation amounts by using a correction table according to the difference in center position between the developer image of the predetermined reference color and the developer images of the other colors.

7. The image forming apparatus according to claim 1, wherein the control unit is configured to identify a boundary between the color developer image and the black developer image by comparing the detection result of the detection unit with a threshold value.

8. The image forming apparatus according to claim 1, wherein the control unit is configured to cause the image forming unit to form the positional deviation correction pattern in such a manner that a black developer is disposed between color developer images of a first color and a black developer image is not disposed between color developer images of a second color different from the first color.

9. The image forming apparatus according to claim 1, wherein the control unit is configured to cause the image forming unit to form the positional deviation correction pattern in such a manner that an interval between the two color developer images of the same color and a width of the black developer image are substantially equal to each other.

10. The image forming apparatus according to claim 1, wherein the control unit is configured to correct at least one of main-scanning direction deviation and sub-scanning direction deviation based on the detection result detected by the detection unit.

11. The image forming apparatus according to claim 1, wherein the detection unit includes:

an irradiation unit configured to irradiate a developer image with light; and a light receiving unit configured to receive diffused reflection light from the developer image.

12. The image forming apparatus according to claim 1, wherein, within the color developer images, a density of a first region that is an edge on a downstream side in conveyance direction is deeper than that of a second region.

13. The image forming apparatus according to claim 1, wherein the black developer image is defined as a reference color and the color developer image is defined as a measured color.

14. The image forming apparatus according to claim 1, wherein in a direction perpendicular to a surface of the bearing member, the black developer image is superimposed on either of the two color developer images of a same color.

15. An image forming apparatus comprising:

an image forming unit configured to form a positional deviation correction pattern including developer images of a plurality of colors on an image bearing member;

a detection unit configured to emit light to the positional deviation correction pattern formed by the image forming unit to detect reflected light from the positional deviation correction pattern; and a control unit configured to perform positional deviation correction based on the detected result by the detection unit, wherein the control unit causes the image forming unit to form the positional deviation correction pattern in such a manner that one black developer image is disposed between two color developer images of a same color, and not whole of the one black developer image but a part thereof is superimposed, in a direction perpendicular to a surface of the image bearing member, on either of the two color developer images of a same color in a state where positional deviation occurs between developer images of a plurality of different colors, and a black developer image is not disposed between color developer images of a second color different from the first color, calculates, by using the color developer image of the first color as a reference color, positional deviation amounts of developer images of other colors with respect to the reference color, and performs positional deviation correction based on the positional deviation amounts.

wherein a sweeping in the color developer images occurs at a downstream edge in a conveyance direction of a transfer medium on which the color developer images are formed, wherein a timing to detect the edge of the color developer images in the detected result obtained by the detection unit is affected by a detection error due to the sweeping, and wherein the control unit obtains a center position of the two color developer images of a same color and a center position of the one black developer image based on the detected result detected by the detection unit, and cancels the detection error by obtaining a positional deviation amount based on the center position of the two color developer images of a same color and a center position of the one black developer image.

16. The image forming apparatus according to claim 15, wherein the control unit calculates the positional deviation amounts according to a value acquired by doubling a difference in center position between the developer image of the first color set as the reference color and the black developer image.

17. The image forming apparatus according to claim 15, wherein the control unit calculates the positional deviation amounts by using a correction table according to the difference in center position between the developer image of the first color set as the reference color and the black developer image.

18. The image forming apparatus according to claim 15, wherein the control unit causes the image forming unit to form the positional deviation correction pattern in such a manner that the black developer image is prevented from being superposed on one of the two color developer images of the same first color in a state where no positional deviation occurs between the developer images of the plurality of different colors.

19. The image forming apparatus according to claim 15, wherein the control unit causes the image forming unit to form the positional deviation correction pattern in such a manner that a width of sweeping occurring in the color developer image of the first color is larger than a superposed width of the black developer image on one of the two color developer images of the same first color in a state where positional deviation occurs between the developer images of the plurality of different colors.

20. The image forming apparatus according to claim 15, wherein the control unit identifies a boundary between the color developer image of the first color and the black developer image by comparing the detection result detected by the detection unit with a threshold value.

21. The image forming apparatus according to claim 15, wherein the control unit causes the image forming unit to form the positional deviation correction pattern in such a manner that an interval between the two color developer images of the first same color and a width of the black developer image is substantially equal to each other.

22. The image forming apparatus according to claim 15, wherein the control unit corrects at least one of main-scanning direction deviation and sub-scanning direction deviation based on the detection result detected by the detection unit.

23. The image forming apparatus according to claim 15, wherein the detection unit includes:

an irradiation unit configured to irradiate a developer image with light; and a light receiving unit configured to receive diffused reflection light from the developer image.

24. The image forming apparatus according to claim 15, wherein in a direction perpendicular to a surface of the bearing member, the black developer image is superimposed on either of the two color developer images of a same color.

25. An image forming apparatus comprising:

an image forming unit configured to form a positional deviation correction pattern including developer images of a plurality of colors;

a detection unit configured to emit light to the positional deviation correction pattern formed by the image forming unit to detect reflected light from the positional deviation correction pattern; and a control unit configured to perform positional deviation correction based on the positional deviation amounts detected by the detection unit, wherein the positional deviation correction pattern is formed at least from two color developer images of a same color and one black developer image, and wherein the one black developer image is disposed between the two color developer images of a same color, the two color developer images of a same color is not superimposed on the one black developer image, and the two color developer images of a same color and the one black developer image are formed so as to be adjacent to each other, wherein a sweeping in the color developer images occurs at a downstream edge in a conveyance direction of a transfer medium on which the color developer images are formed, wherein a timing to detect the edge of the color developer images in the detected result obtained by the detection unit is affected by a detection error due to the sweeping, and wherein the control unit obtains a center position of the two color developer images of a same color and a center position of the one black developer image based on the detected result detected by the detection unit, and cancels the detection error by obtaining a positional deviation amount based on the center position of the two color developer images of a same color and a center position of the one black developer image.

* * * * *